US008287352B2

(12) United States Patent
Pollack

(10) Patent No.: US 8,287,352 B2
(45) Date of Patent: Oct. 16, 2012

(54) BINOMIAL AND MULTINOMIAL-BASED SLOT MACHINE

(76) Inventor: Jordan B. Pollack, Sudbury, MA (US)

( * ) Notice: Subject to any disclaimer, the term of this patent is extended or adjusted under 35 U.S.C. 154(b) by 645 days.

(21) Appl. No.: 12/378,727

(22) Filed: Feb. 19, 2009

(65) Prior Publication Data

US 2010/0210342 A1 Aug. 19, 2010

(51) Int. Cl.
*G07F 17/32* (2006.01)

(52) U.S. Cl. ..... 463/17; 463/13; 463/26; 463/21

(58) Field of Classification Search ..... 463/25
See application file for complete search history.

(56) References Cited

U.S. PATENT DOCUMENTS

| | | | | |
|---|---|---|---|---|
| 5,704,835 | A | 1/1998 | Dietz, II | 463/20 |
| 6,117,009 | A | 9/2000 | Yoseloff | 463/20 |
| 6,159,096 | A | 12/2000 | Yoseloff | 463/20 |
| 6,641,477 | B1 | 11/2003 | Dietz, II | 463/20 |
| 6,755,737 | B2 * | 6/2004 | DeSimone et al. | 463/16 |
| 6,855,054 | B2 | 2/2005 | White et al. | 463/21 |
| 7,470,182 | B2 | 12/2008 | Martinek et al. | 463/16 |
| 7,946,916 | B2 * | 5/2011 | Naicker | 463/20 |
| 2003/0064797 | A1 * | 4/2003 | Jackson et al. | 463/25 |
| 2003/0214097 | A1 * | 11/2003 | Moody | 273/292 |
| 2006/0183532 | A1 | 8/2006 | Jackson | 463/20 |

* cited by examiner

*Primary Examiner* — Zandra Smith
*Assistant Examiner* — Tsz Chiu
(74) *Attorney, Agent, or Firm* — Mark A. Litman & Associates, P.A.

(57) ABSTRACT

A gaming apparatus performs a gaming method with a symbol display system for a wagering game, a processor controlling the symbol display system and software executed by the processor, has software perform electronic functions of:

a) providing a method of value crediting and debiting system;
b) providing a game control component that determines rules of play of a game;
c) providing activation of selection from virtual spinners that have individual game determinant outcomes or individual symbol determinant outcomes mathematically distributed within the virtual outcome determinant space of the virtual spinner;
d) providing a file of images available for display on the symbol display system;
e) the software randomly accessing the predetermined weighted portions of the outcome determinant space to select individual symbols, sets of symbols or collective symbols for use in the game;
f) determining game outcomes; and
g) resolving all value placed at risk in the play of the game.

17 Claims, 7 Drawing Sheets

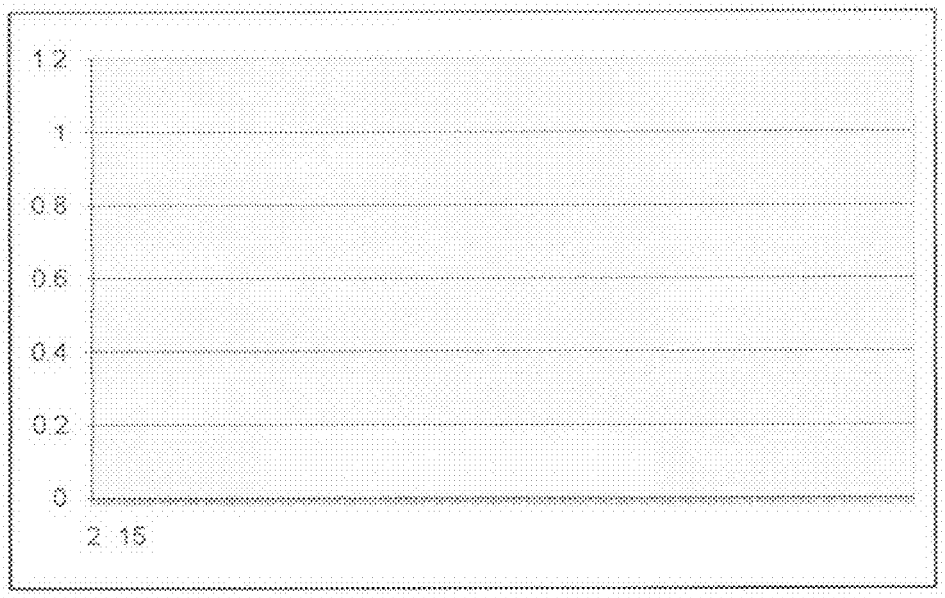
Figure 1: Increasing player return as more fair binary spinners (e.g. coin flips) are bet upon.
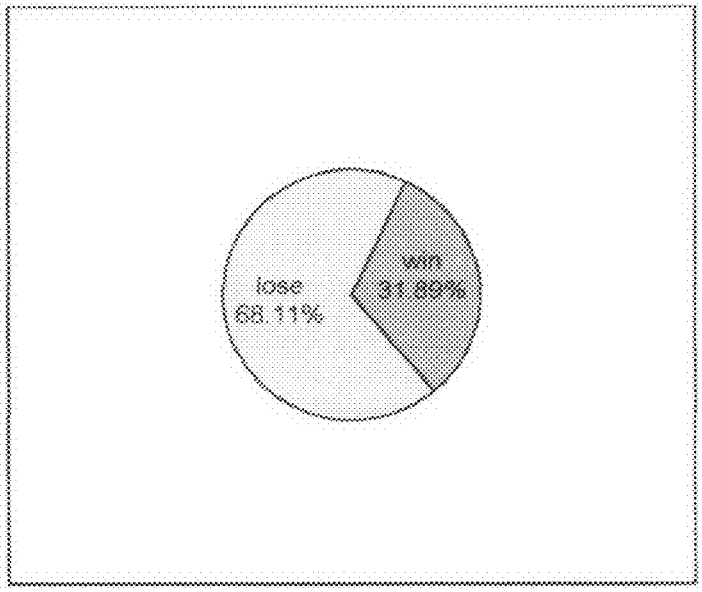
Figure 2: When player one rolls first the outcomes form a weighted coin, shown by this spinner.

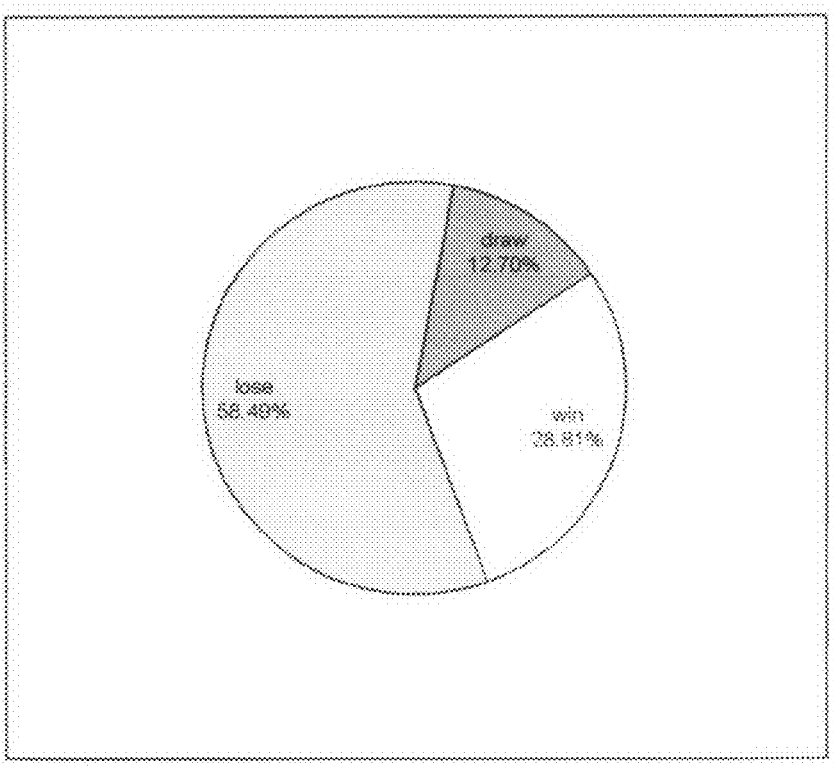
Figure 3: Distribution of random play of Tic Tac Toe, from Player 2's perspective.

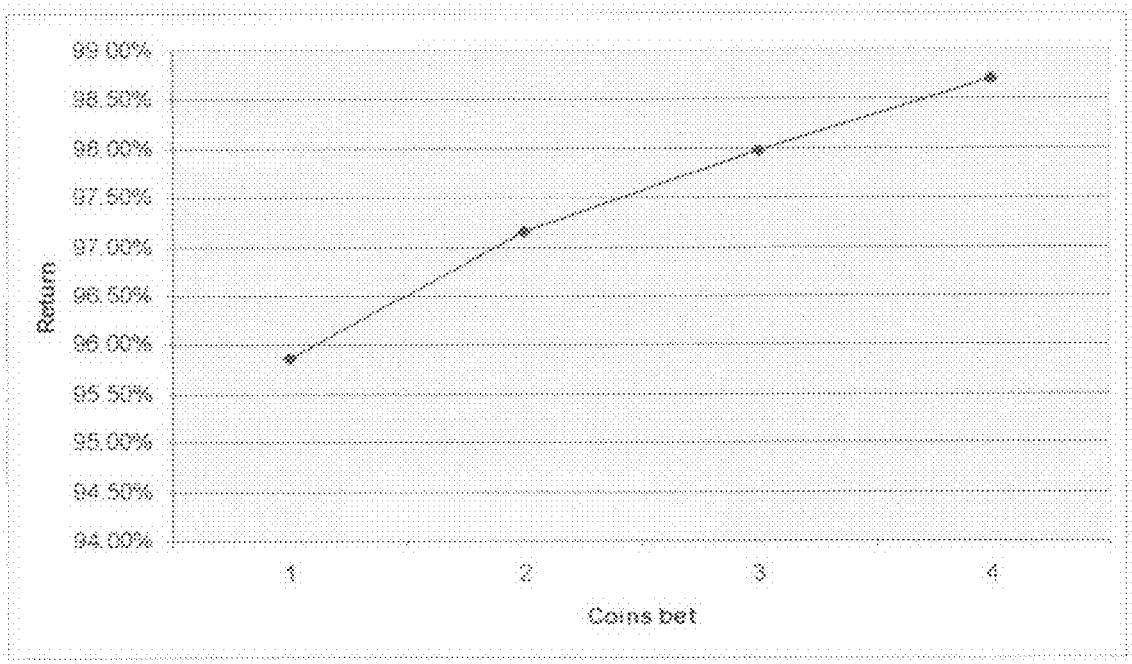
Figure 4: increasing returns can be set up 3, 6, 9, and 12 boards of random TicTacToe.
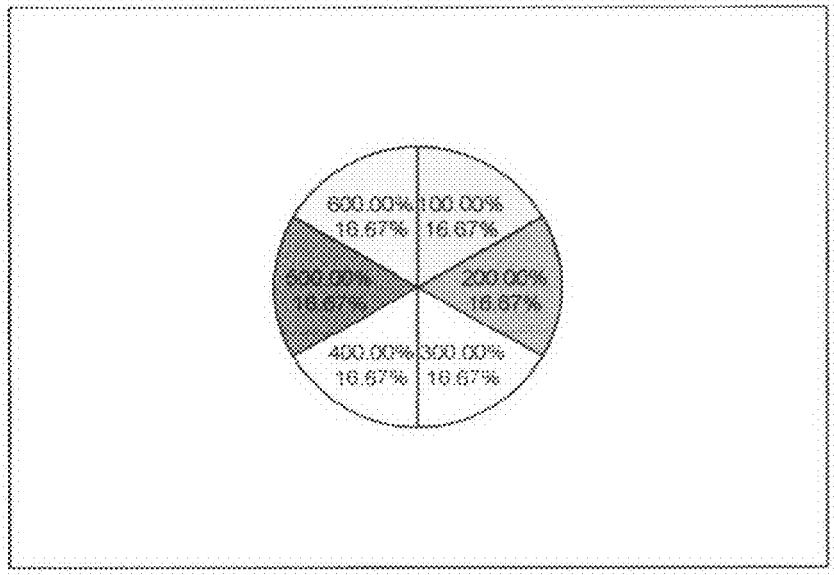
Figure 5: the distribution of outcomes from a fair 6-sided die.

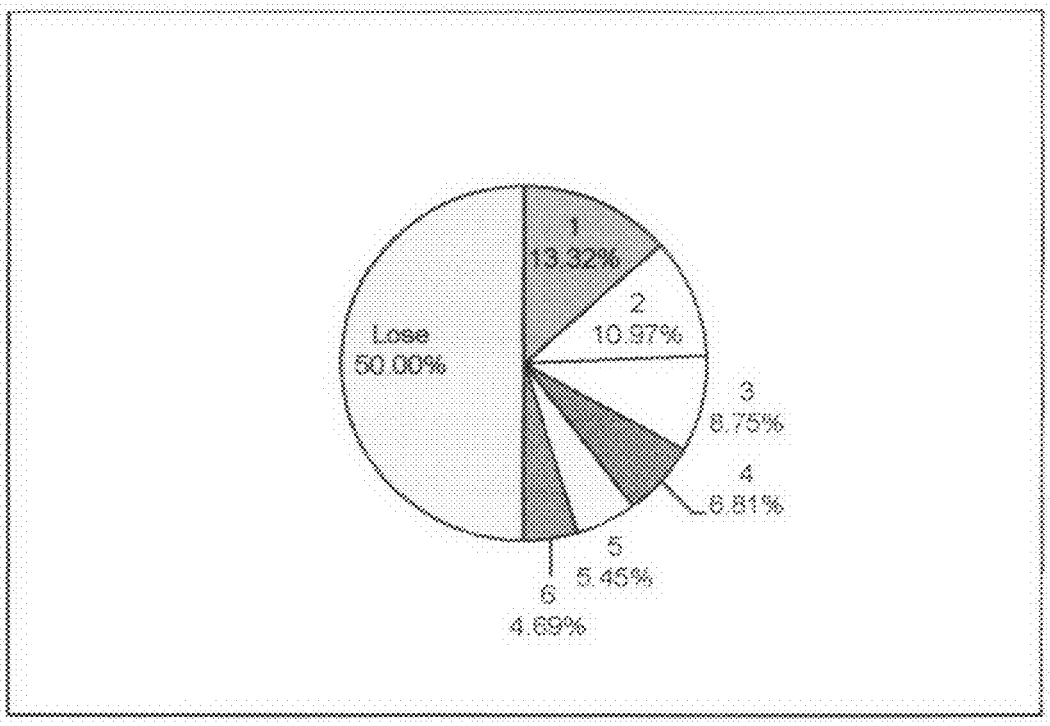
Figure 6: Nannon® game endings as a 7-sided spinner.

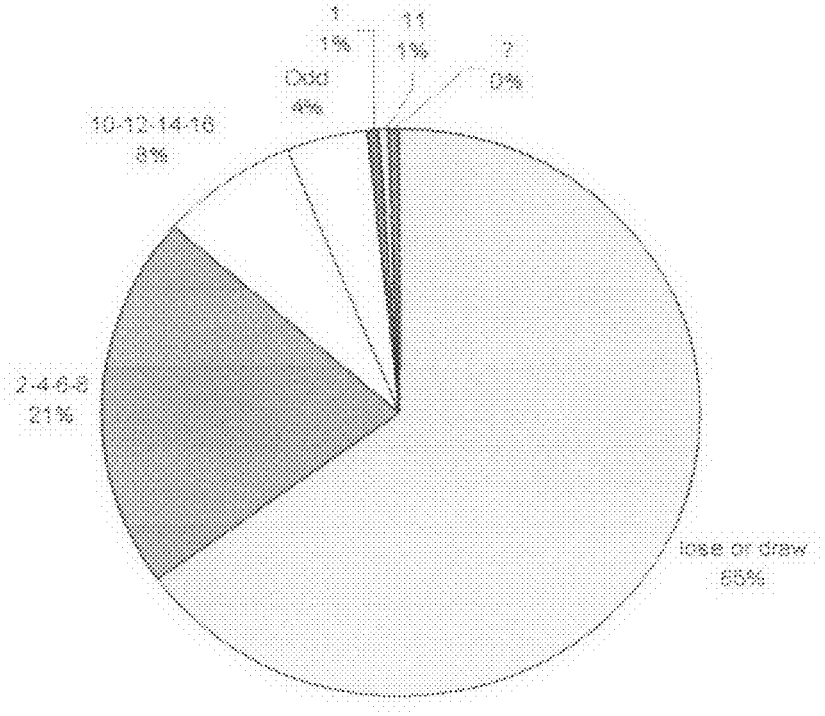
Figure 7: Clustered outcomes of 4x4 Othello game

Figure 8: Spinner derived from 2-card poker hands.
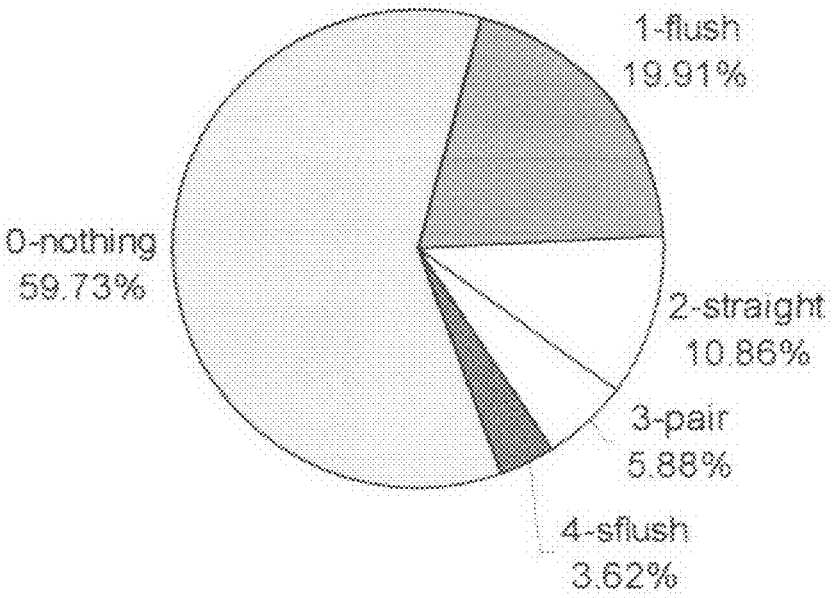
Figure 9: Spinner derived from 5-card poker hands.
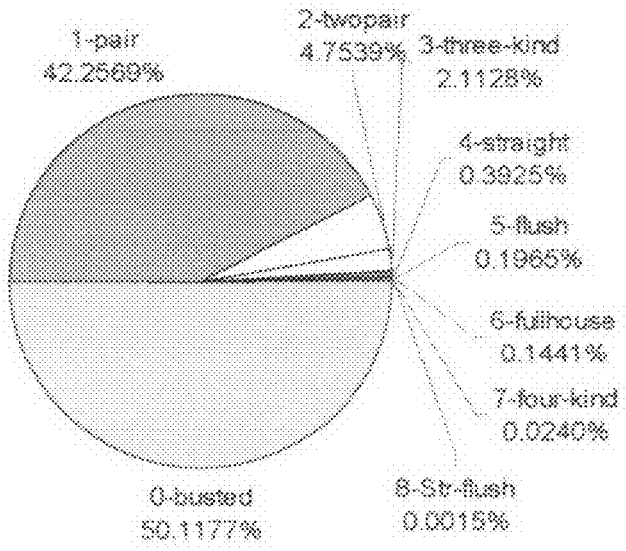

Figure 10: Spinner derived from 3-card poker.
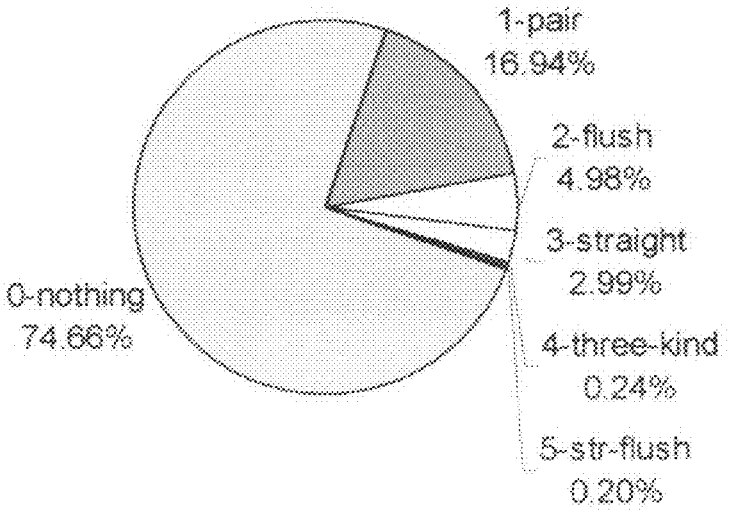
Figure 11: Spinner derived from Blackjack
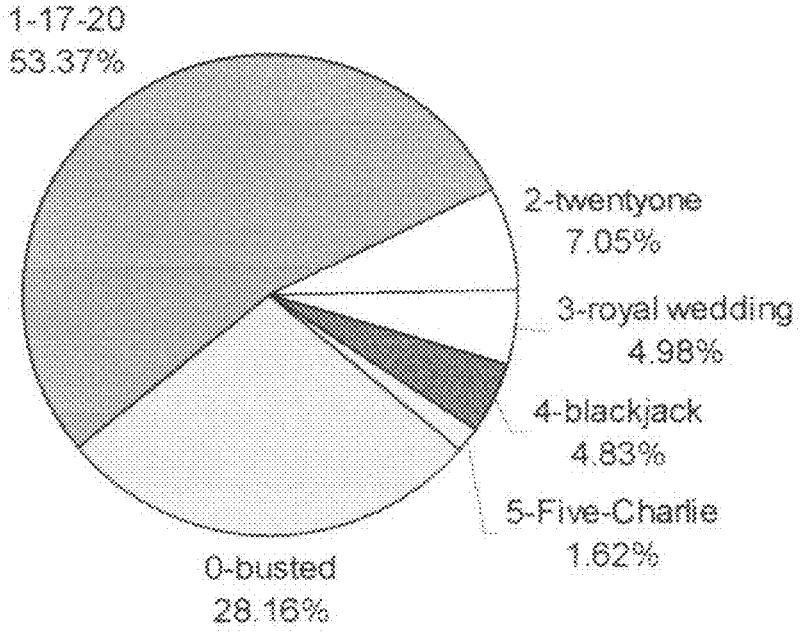

BINOMIAL AND MULTINOMIAL-BASED SLOT MACHINE

BACKGROUND OF THE INVENTION

1. Field of the Invention

The present invention relates to the field of gaming, especially to electronic gaming in processor based apparatus, and in particular to video gaming apparatus in which outcomes are based on random generation of symbols into fields and the attainment of predetermined orders or sets or collections of symbols to identify winning events.

2. Background of the Art

Electronic casino games, whether video poker or slot games, have grown exponentially in numbers in the last twenty years, as have the revenues generated by such machine games. It is estimated that more than three fourths of any casino's revenue is now provided by machine games as opposed to table games.

The casino patron usually gravitates to either table games or machine games due to the very nature of each genre. The table player can be drawn by the camaraderie of group interaction and the typically lower house advantage games with less dramatic win/loss swings. Odds of approximately 1-to-1(within 1-6%) are common in casino table games, and can provide the player with more frequent wins and a slower depreciation of assets. By way of contrast, the machine player is more likely to enjoy solitary play. The solitary player also is motivated to play games that may have larger house advantages but which can provide huge payouts, albeit with a higher degree of volatility. This higher volatility is due to the fact that to provide large or jackpot wins, the game would have many more results which are either a complete loss, a push or a win of less than the total wager. The machine player can become disheartened with a streak of these losing results. Additionally, in games that feature a multiple step game play, the initial spin or deal may appear to be both a losing event and a poor start, which can compound the player's frustration and lead to less time on the machine. There is often the perception that the machine game is "rigged" to provide an inordinate amount of these bad starts, especially after a player has had some initial winning results. Prior art has sought to address these issues, but there is still a need for new inventive game play that gives the player more positive expectations and a feeling that even poor starts can be turned into a win.

U.S. Pat. No. 6,855,054 (White) describes methods of playing games of chance and gaming devices and systems comprising a display of a plurality of symbols where at least one symbol may be interchanged (two way exchange) with another symbol of the plurality of symbols. After a combination of symbols initially is randomly generated and the initial results are displayed to a player, the player may have the opportunity to interchange at least one displayed symbol with another symbol in order to configure a more advantageous symbol arrangement.

U.S. Pat. Nos. 6,641,477 and 5,704,835 (Dietz, II) describe an electronic slot machine and method of use which allows a player to completely replace up to all of the initial symbols displayed after the first draw in order to create, improve or even lose a winning combination. If a suitable winning combination is not formed with the initial symbols, the player is given opportunities to select up to all of the symbol display boxes for replacement.

US Patent Publication No. 20060183532 (Jackson) discloses a display on which symbols may be provided for use in a slot-type wagering game. Symbols are displayed on sectioned geometrical shapes such as ovals, squares, circles, polygons, etc. Specific symbol combinations, particularly comprised of one symbol appearing on one section of each sectioned geometric shape or all symbols appearing on all sections of one sectioned geometric shape, may constitute a winning combination according to a predetermined pay table. Preferably the invention incorporates three 3-section circular reels, providing 30 different pay lines and an additional pay line incorporating all nine sections of the reels.

Disclosed herein is a family of pure-luck slot machines based on mechanized playout of simple one and two player games, using a method of calculating pay tables for two or more spinner devices based on the game. The machines are simple enough to be implemented with physical hardware is random number generators for players who are suspicious of a computer controlling the random element. Computers would still be used to scan the result of the physical events, calculate payout, and operate the payment mechanisms, whether coin, magnetic, printed, wireless, or other future payment methods. The same games could be implemented in existing slot machine platforms, pure software for computers and video game consoles, mobile gaming platforms, pocket computers, cellular phones capable of running game programs, and so forth.

U.S. Pat. Nos. 7,470,182 (Martinek et al.); 6,159,096 (Yoseloff); and 6,117,009 (Yoseloff) disclose novel mapping systems in which all possible final outcomes (e.g., all of the displays available on a three-reel slot) are defined as templates, and each template is assigned a specific probability. A random number generator then selects an individual template to be displayed based on the probability of the specific template.

The present technology advances gaming systems and games as described herein. All references cited in this disclosure are incorporated herein by reference in their entirety to provide background on technical enablement for apparatus, components and methods.

SUMMARY OF THE INVENTION

A gaming apparatus includes a symbol display system for a wagering game, a processor controlling the symbol display system and software executed by the processor, wherein the software comprises executable steps to perform electronic functions of:

a) providing a method of value crediting and value debiting system that identifies value risked in the play of the wagering game and credits awards won in the play of the wagering game;

b) providing a game control component that determines rules of play of a game played on the gaming apparatus;

c) providing activation of symbol and/or event outcome selection by the processor from virtual spinners that have individual game determinant outcomes or individual symbol determinant outcomes mathematically distributed within a virtual outcome determinant space of the virtual spinner;

d) providing a file of images available for display on the symbol display system, the specific display of individual symbols, sets of symbols or collective symbols being determined by predetermined weighted portions of the outcome determinant space;

e) the software responding to user commands to initiate a game by randomly accessing the predetermined weighted portions of the outcome determinant space to select individual symbols, sets of symbols or collective symbols for use in the game;

f) determining whether the randomly accessed predetermined weighted portions of the outcome determinant space has provided individual symbols, sets of symbols or collective symbols that constitute a win according to the game; and g) resolving all wagers on all value placed at risk in the play of the game.

The "virtual spinners" are distributions of probabilities of outcomes (e.g., specific portions of the virtual spinner or mathematically defined regions of probability) that totals effectively 100% from all of its regions of probability. Specific regions (which can be equated to specific symbol outcomes or event outcomes) of the virtual spinner are determined to have weighted probabilities of being selected, and each region (outcome) will have associated with it a predetermined symbol display outcome (when individual symbols or less than complete subsets of symbols are displayed) or predetermined complete symbol display outcome (event outcome) that is selected. These outcomes or regions may be final outcomes (end of game outcomes with all steps completed for game play) or may be an intermediate event determination (e.g., a first move of the markers in a Nannon® virtual board game, with subsequent outcomes indicating subsequent steps or moves by random weighted selection of die or dice outcomes or a bonus triggering event in combination with any of the preceding steps.) Another example may be final outcomes of a blackjack hand, with intermediate events being the sequential deal of cards to the hand. This is more complex, as there are options that may be exercised by players that could differentiate play of blackjack hands to conclusion.

The game may be a game in which outcomes are determined by one or more displays of symbols selected from group consisting of playing cards, specialty cards, dice and spinners and wherein the file of images stored in memory and accessible by the processor for display may include virtual dice and virtual token positions on a virtual game board. The game outcome may be determined by repeated random selection of predetermined weighted portions to make repeated moves of the virtual tokens on the virtual game board. The virtual game board may be a truncated backgammon board, e.g., wherein the virtual game board has only six available positions on the virtual game board for positioning of virtual tokens. The symbols may be selected from the group consisting of symbols to be randomly displayed, symbols or markers (location markers, pegs in cribbage, etc.) to fill preexisting spaces in a game board, playing cards, dice and coins. Each symbol or a set of symbols may be determined by the software according to the random selection of the predetermined weighted portions of the outcome determinant space. The gaming apparatus may have the predetermined weighted portions of the outcome determinant space (virtual space or mathematical space) selected so that on a long-term probability basis, for example, so that between 92 and 99% of total wagers placed by players (or whatever total is designed into the game) will be returned to players in winning or pushing events. These spaces may remain constant through repeated games or vary from game to game in a further random manner, with different spinners randomly selected for each game.

A method of playing a game on the gaming apparatus described above would have a payout system wherein none of, portions of or the total of player credits or winnings are returned to players at player direction by player input to the gaming apparatus either as coins, credits, tokens or printed credit slip. The random selection of predetermined weighted portions of the outcome determinant space may determine discrete (e.g., intermediate, partial, single step, etc.) outcomes in a board game or card game. For example, outcomes from the virtual spinner are selected from the group consisting of a distinguished LOSE state, and a set of winning states each determined by a weighted probability, wherein each weighted probability is used to calculate binomial or multinomial coefficients which may be used to determine the payout levels.

BRIEF DESCRIPTION OF THE FIGURES

FIG. 1 is a graph representing change in level of wagering based on statistical changes in fairness of spinner values and distributions.

FIG. 2 is a graphic representation of when a player one rolls first the outcomes form a weighted coin, shown by this spinner.

FIG. 3 is a graphic representation of a distribution of random play of Tic Tac Toe, from Player 2's perspective.

FIG. 4 is a graphic representation that increasing returns can be set up on 3, 6, 9, and 12 boards of random TicTacToe.

FIG. 5 is a graphic representation of spinner outcomes from a fair, six-sided die.

FIG. 6 shows a graphic representation of Nannon® game endings as a 7-sided spinner.

FIG. 7 shows a graphic representation of Clustered outcomes of 4×4 Othello game FIG. 8 is a graphic representation of a Spinner derived from 2-card poker hands.

FIG. 9: is a graph of a Spinner derived from 5-card poker hands.

FIG. 10 is a graphic representation of a Spinner derived from 3-card poker.

FIG. 11 is a graphic representation of a Spinner derived from Blackjack

DETAILED DESCRIPTION OF THE INVENTION

One aspect of the present invention is to turn traditional recognizable games using coins, dice, spinners, cards, checkers, and so forth, into slot machine concepts which are easy to recognize, to understand and play, while providing the house with flexibility at setting the return and reinforcement. A gaming apparatus comprising a symbol display system for a wagering game, a processor controlling the symbol display system and software executed by the processor. The software has the ability to perform electronic functions enabling play of a wagering game. The functions a) provide a method of value crediting and debiting system that identifies value risked in the play of the wagering game and awards won in the play of the wagering game; b) provide a game control component that determines rules of play of a game played on the gaming apparatus; c) provide activation of selection from virtual spinners that have individual game determinant outcomes or individual symbol determinant outcomes mathematically distributed within the virtual outcome determinant space of the virtual spinner; d) provide a file of images available for display on the symbol display system, the specific display of individual symbols, sets of symbols or collective symbols being determined by predetermined weighted portions of the outcome determinant space; e) the software responds to user commands to initiate a game by randomly accessing the predetermined weighted portions of the outcome determinant space to select individual symbols, sets of symbols or collective symbols for use in the game; f) determines whether the randomly accessed predetermined weighted portions of the outcome determinant space has provided individual symbols, sets of symbols or collective symbols that constitute a win according to the game; and g) resolves all value placed at risk in the play of the game.

The present technology may be incorporated into gaming events using either real (physical) spinners or electronic spinners. In using physical or mechanical spinners, the physical spinners may be used in real time, or a table established for continual use in a game or multiple spinners used contemporaneously to establish the probabilities or outcomes. For example, a spinner (e.g., two dice) may be cast, observed by image capturing systems (e.g., analog or digital cameras), and the spinner outcome analyzed and used upon electronic entry into a gaming processor system, to determine symbol outcome or event outcome (based on an existing look-up table for event outcomes). In this practice, it is to be understood that the roll of the dice is not itself the event outcome, but is a spinner determining separate symbol or event outcomes. Distal image capture of actual gaming events and use of those distal outcomes in standard wagering formats (e.g., Rapid Roulette® systems) is known in the art. Non-limiting Examples of physical play that can be used in the practice of the present technology includes, but is not limited to, flipping a predetermined number of coins (e.g., 5, 8, 10, 12 or 15 physical coins, using computer vision to count the number of heads that come up, then paying out from the paytable), or randomly ordering 9 numbered marbles into a permutation, reading the order with computer analysis of the outcome, and using the outcome as the RNG for a software tictactoe game; rolling a sequence of dice which are read by computer vision and used in moving Nannon® game pieces on a virtual board; and dealing 5 cards from a new shuffle and using vision/barcode and the game algorithm to sequentially reveal a blackjack hand from 2 to 5 cards according to the rules of blackjack.

An alternative method is to use virtual spinners in the determination of symbol outcomes (i.e., individual symbol occurrence during play of a game) or event (including partial event) outcome (e.g., an initial hand dealt in 5-card draw poker, or a complete 5-card hand in stud poker, or any other final game event outcome). In using a virtual spinner, a look up table is provided with the distribution of probabilities already established (by mathematic or actual event outcome performance over a statistically significant number of events, as is required in the gaming industry for compliance) and that look-up table is accessed by use of a random number generator selecting a specific outcome in the table, and that outcome being already associated with specific symbol outcomes or event outcomes is used to determine the symbol or event occurring in the play of the game.

An important element in an appreciation of the advance of the present technology is the definition of the term "virtual spinner." A statistical or probabilistic distribution is created based on real-life events having determinable probabilities. Existing event series (consecutive coin flips, consecutive selections from among equally weighted selections, etc.), games (poker games, blackjack games, baccarat games, Tic-Tac-Toe games, etc.) or defined physical events (die roll, dice roll, card cutting, coin flipping, candy wheel spinning, etc,). The actual probability distribution of the real-life event is then mathematically distributed as segments within a region that is the basis of selection by a random number generator. The random number generator then randomly selects among the statistical regions provided by the real-life event. The symbol outcomes or event outcomes are associated with each of these regions so that the random number generator's selection of any region determines a symbol outcome (in a specific or general location) or an event outcome. Once the probabilities of the regions of the real-life event have been determined, those regions may be artificially weighted in association with specific symbol outcomes, symbol locations and/or event outcomes. The weighting of the regions offers a core basis of probabilities based on real-life events that can be adjusted to create designed returns from wagering games on automated wagering systems. The automated wagering systems may be in the form of slot type machines (either reel-type or video type), poker-type machines (single game, multi-line, stud, draw, 2-card, 3-card, 4-card, 5-card, 6-card, 7-card, hi-lo, etc.), video blackjack, bonus games and the like.

In these new machines a random element we call a SPINNER is replicated more than once at the choice of the player. The SPINNERS are operated quickly and in parallel called a THROW (a single game play or game event). Each spinner has a finite set of OUTCOMES of non-increasing probabilities which sum to 100%. The first outcome with the largest probability is considered the ZERO state, and the other outcomes may be labeled 1, 2, 3 . . . and so on. The spinner may be exemplified or displayed as simple coins, dice, or spinners or mechanical contrivances which appear in a known game such as tic-tac-toe, checkers, chess, Othello, or backgammon and the like. A spinner can be a solitaire or two player games where robots or other automated systems shuffle, deal or roll randomly, using checkers, markers, marbles, or playing cards. The SPINNER can be implemented physically or purely in software, with or without display to the player. Once the final outcome of each SPINNER is determined, the SUM of the outcomes is used to resolve a wager against a payout table based on the size of the bet and the player is paid according to that resolution.

Allowing the player to choose how many SPINNERS to bet on, and calculating the reward based on the binomial or multinomial coefficients leads to a new class of simple slot machines based on known games.

As will be disclosed below, the bet, the size of the jackpot, the player return (house edge), and the win/lose ratio (the reinforcement) are all adjustable to achieve the values required by profitability, legal framework, and player psychology.

From several examples, the novelty of this new kind of slot machine will be clear to those experienced in the art. Even though many video poker games exist, including ones which allow 5, 50 or 100 "hands" to be played in parallel, each payout event only leads to an independent payoff summed for each hand, such as $3 for each flush or $10 for each full house. In the present invention when applied to poker, the total payout in a single round of play will be exponentially increased as each independent deal of hands played contemporaneously results in a good hand.

Machines Using Binomial Distribution.

The new board game of NANNON® game, by this inventor, is a simplified family of games based on the ancient game of Backgammon. It is a two-player dice/race/hitting/blocking game, but uses a shorter board, fewer checkers, and employs adjacency rather than stacking for creating blockades which can cause an opponent to lose their turn. This family game is cyclical and enjoys a lot of turnabout in expectations, yet has no draw or stalemate and inevitably ends. When a computer strategy plays against itself, each player will win 50% of the time, just like flipping a coin It was through diligent design of a slot machine based on NANNON® game that the present invention emerged.

Consider a machine which used a fair random binary element, such as a coin with two landing states "heads" and "tails". There are two outcomes with non-increasing probability distribution [0.5 and 0.5]. Tails would be considered a ZERO, a worse outcome then heads (1). Consider a machine which flips multiple fair coins and guarantees flat landings and no interference between the coins. A computer sensor would count the resultant number of heads and calculate the sum (which is counting the "heads"). The sum would indicate a line in a payout table to return to the player. A virtual coin-flip can also be done with any software random number generator (RNG) and a threshold. We conceptualize the flipping coin as a SPINNER as a pie-chart in FIG. 1 where a spinning arrow would land according to the distribution.

The present system may be implemented by various combinations of processors, RAM, EPROM, video displays, interconnected through I/O ports and USB ports. A central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, may also be determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, controlling, altering, reducing or eliminating win-loss volatility and the like.

There are hundreds of available computer languages that may be used to implement embodiments of the invention, among the more common being Ada; Algol; APL; awk; Basic; C; C++; Cobol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PUI; Prolog; Python; Rexx; SAS; Scheme; sed; Simula; Smalltalk; Snobol; SQL; Visual Basic; Visual C++; and XML.

Any commercial processor may be used to implement the embodiments of the invention either as a single processor, serial or parallel set of processors in the system. Examples of commercial processors include, but are not limited to Merced™, Pentium™, Pentium II™, Xeon™, Celeron™, Pentium PrO™, Efficeon™, Athlon™, AMD and the like. Display screens may be segment display screen, analogue display screens, digital display screens, CRTs, LED screens, Plasma screens, liquid crystal diode screens, and the like.

It will be understood that this implementation is merely illustrative. For example, the there could be more or less reels with scatter symbols. The reels selected for the example are purely illustrative. Embodiment of the present invention can be readily added to existing games with modifications as required.

The term reels should be understood in include games in which symbols are arranged in different geometric patterns, with specific groups of symbols which move in a coordinated way being considered as reels. It will be appreciated that the present invention is of broad application, and can be implemented in a variety of ways. Variations and additions are possible within the general scope of the present invention.

One further basis of appreciating the scope of the present technology is to consider flipping 10 coins. The probability that all coins would come up "heads" is just 1/1024. A machine can take a $1 bet, and pay $1000 just in the case of ALL HEADS. The RETURN of this slot machine is 1000/1024 or 97.66% but this is not a fun machine.

When n coins are flipped, the probability that the sum of "heads" will be k (for k from 0 to n) is given by $$\binom{n}{k}$$

which can be calculated as $$\frac{n!}{k!(n-k)!}.$$

The Binomial coefficients are popularly known as "Pascal's Triangle" in the table below, where each entry is the sum of the two elements above it and above it to the left. Each row show the binomial coefficients for 1 through n coins, the columns represent k for 0 through n heads. Each row sums to $2^n$ accounting for all possible events.

| | heads | | | | | | | | | | | |
|---|---|---|---|---|---|---|---|---|---|---|---|---|
| coins | 0 | 1 | 2 | 3 | 4 | 5 | 6 | 7 | 8 | 9 | 10 | Total Even |
| 1 | 1 | 1 | | | | | | | | | | 2 |
| 2 | 1 | 2 | 1 | | | | | | | | | 4 |
| 3 | 1 | 3 | 3 | 1 | | | | | | | | 8 |
| 4 | 1 | 4 | 6 | 4 | 1 | | | | | | | 16 |
| 5 | 1 | 5 | 10 | 10 | 5 | 1 | | | | | | 32 |
| 6 | 1 | 6 | 15 | 20 | 15 | 6 | 1 | | | | | 64 |
| 7 | 1 | 7 | 21 | 35 | 35 | 21 | 7 | 1 | | | | 128 |
| 8 | 1 | 8 | 28 | 56 | 70 | 56 | 28 | 8 | 1 | | | 256 |
| 9 | 1 | 9 | 36 | 84 | 126 | 126 | 84 | 36 | 9 | 1 | | 512 |
| 10 | 1 | 10 | 45 | 120 | 210 | 252 | 210 | 120 | 45 | 10 | 1 | 1024 |

When each element in a row is divided by the sum, we get in each column the probability of the sum of coins adding up to k. The total probability distribution sums to 100%. This is shown in the table below.

| | 0 | 1 | 2 | 3 | 4 | 5 | 6 | 7 | 8 | 9 | 10 | total |
|---|---|---|---|---|---|---|---|---|---|---|---|---|
| 1 | 0.5 | 0.5 | 0 | 0 | 0 | 0 | 0 | 0 | 0 | 0 | 0 | 100% |
| 2 | 0.25 | 0.5 | 0.25 | 0 | 0 | 0 | 0 | 0 | 0 | 0 | 0 | 100% |
| 3 | 0.125 | 0.375 | 0.375 | 0.125 | 0 | 0 | 0 | 0 | 0 | 0 | 0 | 100% |
| 4 | 0.0625 | 0.25 | 0.375 | 0.25 | 0.0625 | 0 | 0 | 0 | 0 | 0 | 0 | 100% |
| 5 | 0.0313 | 0.1563 | 0.3125 | 0.3125 | 0.1563 | 0.0313 | 0 | 0 | 0 | 0 | 0 | 100% |
| 6 | 0.0156 | 0.0938 | 0.2344 | 0.3125 | 0.2344 | 0.0938 | 0.0156 | 0 | 0 | 0 | 0 | 100% |
| 7 | 0.0078 | 0.0547 | 0.1641 | 0.2734 | 0.2734 | 0.1641 | 0.0547 | 0.0078 | 0 | 0 | 0 | 100% |
| 8 | 0.0039 | 0.0313 | 0.1094 | 0.2188 | 0.2734 | 0.2188 | 0.1094 | 0.0313 | 0.0039 | 0 | 0 | 100% |
| 9 | 0.002 | 0.0176 | 0.0703 | 0.1641 | 0.2461 | 0.2461 | 0.1641 | 0.0703 | 0.0176 | 0.002 | 0 | 100% |
| 10 | 0.001 | 0.0098 | 0.0439 | 0.1172 | 0.2051 | 0.2461 | 0.2051 | 0.1172 | 0.0439 | 0.0098 | 0.00098 | 100% |

In order to make flipping 10 coins "fun" we establish a minimum pay event which is more likely than "all heads" and derive a set of payoffs. The table below shows for the 10-coin problem, the number of heads, the binomial coefficients, which sum to 1024, the probability distribution, and 100% "fair" return calculations for minimums from 10 (all heads) to 5 coins (half must be heads). With a "Pay on 5 heads or more" policy, instead of winning 1000× once every 1024 plays, the player gets "positive feedback" 62% of the time with a maximum 200× jackpot. Pay on 6 heads gets reinforcement 38% of the time. For this invention, the choice of reinforcement level is discrete, linked mathematically to the number of paylines chosen.

| HEADS | 10 | distribution | 10 | 9 | 8 | 7 | 6 | 5 |
|---|---|---|---|---|---|---|---|---|
| 0 | 1 | 0.000976563 | 0 | 0 | 0 | 0 | 0 | 0 |
| 1 | 10 | 0.009765625 | 0 | 0 | 0 | 0 | 0 | 0 |
| 2 | 45 | 0.043945313 | 0 | 0 | 0 | 0 | 0 | 0 |
| 3 | 120 | 0.1171875 | 0 | 0 | 0 | 0 | 0 | 0 |
| 4 | 210 | 0.205078125 | 0 | 0 | 0 | 0 | 0 | 0 |
| 5 | 252 | 0.24609375 | 0 | 0 | 0 | 0 | 0 | 0.67725 |
| 6 | 210 | 0.205078125 | 0 | 0 | 0 | 0 | 0.97524 | 0.8127 |
| 7 | 120 | 0.1171875 | 0 | 0 | 0 | 2.13333 | 1.70667 | 1.42222 |
| 8 | 45 | 0.043945313 | 0 | 0 | 7.58519 | 5.68889 | 4.55111 | 3.79259 |
| 9 | 10 | 0.009765625 | 0 | 51.2 | 34.1333 | 25.6 | 20.48 | 17.0667 |
| 10 | 1 | 0.000976563 | 1024 | 512 | 341.333 | 256 | 204.8 | 170.667 |
| total | 1024 | 100.00% | 100.00% | 100.00% | 100.00% | 100.00% | 100.00% | 100.00% |
| | | Feedback | 0.10% | 1.07% | 5.47% | 17.19% | 37.70% | 62.30% |

Even though modern slot machines are electronic and can calculate fractions of coins, integer returns are still expected. On a single coin bet, a "0.67" return would mean ⅔rds of a coin. In order to get these payoffs integer multiples of the bet, the machine can work with multiple coin bets. The table below shows a simple "rounding" of the "minimum 5 heads" payoff for multiple coin bets of 1, 2, 3, 5, 10, and 100 coins.

| | | | COINS | | | | | | |
|---|---|---|---|---|---|---|---|---|---|
| HEADS | 10 | distribution | 5 | 1 | 2 | 3 | 5 | 10 | 100 |
| 0 | 1 | 0.000976563 | 0 | | | | | | |
| 1 | 10 | 0.009765625 | 0 | | | | | | |
| 2 | 45 | 0.043945313 | 0 | | | | | | |
| 3 | 120 | 0.1171875 | 0 | | | | | | |
| 4 | 210 | 0.205078125 | 0 | | | | | | |
| 5 | 252 | 0.24609375 | 0.67725 | 1 | 1 | 2 | 3 | 7 | 68 |
| 6 | 210 | 0.205078125 | 0.8127 | 1 | 2 | 2 | 4 | 8 | 81 |
| 7 | 120 | 0.1171875 | 1.42222 | 1 | 3 | 4 | 7 | 14 | 142 |
| 8 | 45 | 0.043945313 | 3.79259 | 4 | 8 | 11 | 19 | 38 | 379 |
| 9 | 10 | 0.009765625 | 17.0667 | 17 | 34 | 51 | 85 | 171 | 1707 |
| 10 | 1 | 0.000976563 | 170.667 | 171 | 341 | 512 | 853 | 1707 | 17067 |
| total | 1024 | 100.00% | 100.00% | 107.71% | 101.22% | 95.08% | 97.54% | 100.11% | 99.98% |

Thus, with multiple coins which allow fractional payoffs to be given as integers, it is now clear that this arrangement of binomial payoffs, with minor adjustments, can return 93%-100% to the player, providing a normal house profit, and that the player wins something 62% of the time, and there is a "jackpot", in this case of 175-250 times the bet. The table below shows several manually adjusted integer pay-tables for 10 coins in and flipping 10 coins with a "5 heads minimum"

| HEADS | 10 | distribution | 5 | 10 | 10 | 10 | 10 | 10 |
|---|---|---|---|---|---|---|---|---|
| 0 | 1 | 0.000976563 | 0 | | | | | |
| 1 | 10 | 0.009765625 | 0 | | | | | |
| 2 | 45 | 0.043945313 | 0 | | | | | |
| 3 | 120 | 0.1171875 | 0 | | | | | |
| 4 | 210 | 0.205078125 | 0 | | | | | |
| 5 | 252 | 0.24609375 | 0.67725 | 6.77249 | 6 | 5 | 6 | 7 |
| 6 | 210 | 0.205078125 | 0.8127 | 8.12698 | 8 | 10 | 8 | 8 |
| 7 | 120 | 0.1171875 | 1.42222 | 14.2222 | 15 | 15 | 14 | 14 |
| 8 | 45 | 0.043945313 | 3.79259 | 37.9259 | 35 | 25 | 35 | 35 |
| 9 | 10 | 0.009765625 | 17.0667 | 170.667 | 150 | 100 | 175 | 150 |
| 10 | 1 | 0.000976563 | 170.667 | 1706.67 | 1500 | 2500 | 1750 | 2000 |
| total | 1024 | 100.00% | 100.00% | 100.00% | 93.43% | 95.56% | 97.14% | 99.60% |

A 200× payoff is not enough to provoke dreams of instant retirement. In order to achieve a big enough jackpot, 15 or more coins must be flipped. It is an object of this invention that the player can choose how many SPINNERS to bet on, and thus which paytable they want. One simple way is to set the number of spinners by the number of coins bet, e.g. bet 7 coins on 7 spinners, 10 coins on 10 spinners. Alternatively, a multiple of spinners may be triggered by each coin, e.g. 3 spinners for each coin so 5 coins trigger 15 binary spinners. Each change in the number of spinners brings up a different pay table, and the house may adjust these paytables with a slightly increasing return to encourage the player to make larger bets.

Below are sequences of paytables for 2 through 16 fair coin-flips. The first column indicates the number of Heads to show; the second column is the binomial coefficient; the third column is the probability of that many heads showing. The 4th column only shows the paying lines for a single bet, indicated by the number at the top of the column. The 5th column multiplies the paying lines by the number of coins bet to get 100% return, while the 6th column rounds the pay lines to integers.

| HEADS/COINS | 2 pay more than: | | 1 multibet | | |
|---|---|---|---|---|---|
| 0 | 1 | 0.25 | 0 | 0 | |
| 1 | 2 | 0.5 | 1 | 2 | 1 |
| 2 | 1 | 0.25 | 2 | 4 | 5 |
| total | 4 | 100.00% | 100.00% | 100.00% | 87.50% |

| HEADS/COINS | 3 pay more than: | | 2 multibet | | |
|---|---|---|---|---|---|
| 0 | 1 | 0.125 | 0 | 0 | |
| 1 | 3 | 0.375 | 0 | 0 | |
| 2 | 3 | 0.375 | 1.333333333 | 4 | 3 |
| 3 | 1 | 0.125 | 4 | 12 | 13 |
| total | 8 | 100.00% | 100.00% | 100.00% | 91.67% |

| HEADS/COINS | 4 pay more than: | | 2 multibet | | |
|---|---|---|---|---|---|
| 0 | 1 | 0.0625 | 0 | 0 | |
| 1 | 4 | 0.25 | 0 | 0 | |
| 2 | 6 | 0.375 | 0.888888889 | 3.5555556 | 3 |
| 3 | 4 | 0.25 | 1.333333333 | 5.3333333 | 5 |
| 4 | 1 | 0.0625 | 5.333333333 | 21.333333 | 21 |
| total | 16 | 100.00% | 100.00% | 100.00% | 92.19% |

| HEADS/COINS | 5 pay more than: | | 3 multibet | | |
|---|---|---|---|---|---|
| 0 | 1 | 0.03125 | 0 | 0 | |
| 1 | 5 | 0.15625 | 0 | 0 | |
| 2 | 10 | 0.3125 | 0 | 0 | |
| 3 | 10 | 0.3125 | 1.066666667 | 5.3333333 | 5 |
| 4 | 5 | 0.15625 | 2.133333333 | 10.666667 | 10 |
| 5 | 1 | 0.03125 | 10.66666667 | 53.333333 | 50 |
| total | 32 | 100.00% | 100.00% | 100.00% | 93.75% |

| HEADS/COINS | 6 pay more than: | | 3 multibet | | |
|---|---|---|---|---|---|
| 0 | 1 | 0.015625 | 0 | 0 | |
| 1 | 6 | 0.09375 | 0 | 0 | |
| 2 | 15 | 0.234375 | 0 | 0 | |
| 3 | 20 | 0.3125 | 0.8 | 4.8 | 4 |
| 4 | 15 | 0.234375 | 1.066666667 | 6.4 | 6 |
| 5 | 6 | 0.09375 | 2.666666667 | 16 | 16 |
| 6 | 1 | 0.015625 | 16 | 96 | 100 |
| total | 64 | 100.00% | 100.00% | 100.00% | 95.31% |

| HEADS/COINS | 7 pay more than: | | 4 multibet | | |
|---|---|---|---|---|---|
| 0 | 1 | 0.0078125 | 0 | 0 | |
| 1 | 7 | 0.0546875 | 0 | 0 | |
| 2 | 21 | 0.1640625 | 0 | 0 | |
| 3 | 35 | 0.2734375 | 0 | 0 | |
| 4 | 35 | 0.2734375 | 0.914285714 | 6.4 | 6 |
| 5 | 21 | 0.1640625 | 1.523809524 | 10.666667 | 10 |
| 6 | 7 | 0.0546875 | 4.571428571 | 32 | 30 |
| 7 | 1 | 0.0078125 | 32 | 224 | 225 |
| total | 128 | 100.00% | 100.00% | 100.00% | 95.42% |

| HEADS/COINS | 8 pay more than: | | 4 multibet | | |
|---|---|---|---|---|---|
| 0 | 1 | 0.00390625 | 0 | 0 | |
| 1 | 8 | 0.03125 | 0 | 0 | |
| 2 | 28 | 0.109375 | 0 | 0 | |
| 3 | 56 | 0.21875 | 0 | 0 | |
| 4 | 70 | 0.2734375 | 0.731428571 | 5.8514286 | 5 |
| 5 | 56 | 0.21875 | 0.914285714 | 7.3142857 | 7 |
| 6 | 28 | 0.109375 | 1.828571429 | 14.628571 | 15 |
| 7 | 8 | 0.03125 | 6.4 | 51.2 | 50 |
| 8 | 1 | 0.00390625 | 51.2 | 409.6 | 400 |
| total | 256 | 100.00% | 100.00% | 100.00% | 95.80% |

-continued

| HEADS/COINS | 9 pay more than: | | 5 multibet | | |
|---|---|---|---|---|---|
| 0 | 1 | 0.001953125 | 0 | 0 | |
| 1 | 9 | 0.017578125 | 0 | 0 | |
| 2 | 36 | 0.0703125 | 0 | 0 | |
| 3 | 84 | 0.1640625 | 0 | 0 | |
| 4 | 126 | 0.24609375 | 0 | 0 | |
| 5 | 126 | 0.24609375 | 0.812698413 | 7.3142857 | 7 |
| 6 | 84 | 0.1640625 | 1.219047619 | 10.971429 | 10 |
| 7 | 36 | 0.0703125 | 2.844444444 | 25.6 | 25 |
| 8 | 9 | 0.017578125 | 11.37777778 | 102.4 | 100 |
| 9 | 1 | 0.001953125 | 102.4 | 921.6 | 900 |
| total | 512 | 100.00% | 100.00% | 100.00% | 95.96% |

| HEADS/COINS | 10 pay more than: | | 5 multibet | | |
|---|---|---|---|---|---|
| 0 | 1 | 0.000976563 | 0 | 0 | |
| 1 | 10 | 0.009765625 | 0 | 0 | |
| 2 | 45 | 0.043945313 | 0 | 0 | |
| 3 | 120 | 0.1171875 | 0 | 0 | |
| 4 | 210 | 0.205078125 | 0 | 0 | |
| 5 | 252 | 0.24609375 | 0.677248677 | 6.7724868 | 6 |
| 6 | 210 | 0.205078125 | 0.812698413 | 8.1269841 | 8 |
| 7 | 120 | 0.1171875 | 1.422222222 | 14.222222 | 14 |
| 8 | 45 | 0.043945313 | 3.792592593 | 37.925926 | 40 |
| 9 | 10 | 0.009765625 | 17.06666667 | 170.66667 | 150 |
| 10 | 1 | 0.000976563 | 170.6666667 | 1706.6667 | 1750 |
| total | 1024 | 100.00% | 100.00% | 100.00% | 96.89% |

| HEADS/COINS | 11 pay more than: | | 6 multibet | | |
|---|---|---|---|---|---|
| 0 | 1 | 0.000488281 | 0 | 0 | |
| 1 | 11 | 0.005371094 | 0 | 0 | |
| 2 | 55 | 0.026855469 | 0 | 0 | |
| 3 | 165 | 0.080566406 | 0 | 0 | |
| 4 | 330 | 0.161132813 | 0 | 0 | |
| 5 | 462 | 0.225585938 | 0 | 0 | |
| 6 | 462 | 0.225585938 | 0.738816739 | 8.1269841 | 8 |
| 7 | 330 | 0.161132813 | 1.034343434 | 11.377778 | 11 |
| 8 | 165 | 0.080566406 | 2.068686869 | 22.755556 | 22 |
| 9 | 55 | 0.026855469 | 6.206060606 | 68.266667 | 68 |
| 10 | 11 | 0.005371094 | 31.03030303 | 341.33333 | 320 |
| 11 | 1 | 0.000488281 | 341.3333333 | 3754.6667 | 3700 |
| total | 2048 | 100.00% | 100.00% | 100.00% | 97.28% |

| HEADS/COINS | 12 pay more than: | | 6 multibet | | |
|---|---|---|---|---|---|
| 0 | 1 | 0.000244141 | 0 | 0 | |
| 1 | 12 | 0.002929688 | 0 | 0 | |
| 2 | 66 | 0.016113281 | 0 | 0 | |
| 3 | 220 | 0.053710938 | 0 | 0 | |
| 4 | 495 | 0.120849609 | 0 | 0 | |
| 5 | 792 | 0.193359375 | 0 | 0 | |
| 6 | 924 | 0.225585938 | 0.63327149 | 7.5992579 | 7 |
| 7 | 792 | 0.193359375 | 0.738816739 | 8.8658009 | 8 |
| 8 | 495 | 0.120849609 | 1.182106782 | 14.185281 | 14 |
| 9 | 220 | 0.053710938 | 2.65974026 | 31.916883 | 31 |
| 10 | 66 | 0.016113281 | 8.865800866 | 106.38961 | 106 |
| 11 | 12 | 0.002929688 | 48.76190476 | 585.14286 | 600 |
| 12 | 1 | 0.000244141 | 585.1428571 | 7021.7143 | 7150 |
| total | 4096 | 100.00% | 100.00% | 100.00% | 97.45% |

| HEADS/COINS | 13 pay more than: | | 7 multibet | | |
|---|---|---|---|---|---|
| 0 | 1 | 0.00012207 | 0 | 0 | |
| 1 | 13 | 0.001586914 | 0 | 0 | |
| 2 | 78 | 0.009521484 | 0 | 0 | |
| 3 | 286 | 0.034912109 | 0 | 0 | |
| 4 | 715 | 0.087280273 | 0 | 0 | |
| 5 | 1287 | 0.157104492 | 0 | 0 | |
| 6 | 1716 | 0.209472656 | 0 | 0 | |
| 7 | 1716 | 0.209472656 | 0.681984682 | 8.8658009 | 8 |
| 8 | 1287 | 0.157104492 | 0.909312909 | 11.821068 | 11 |
| 9 | 715 | 0.087280273 | 1.636763237 | 21.277922 | 22 |
| 10 | 286 | 0.034912109 | 4.091908092 | 53.194805 | 50 |
| 11 | 78 | 0.009521484 | 15.003663 | 195.04762 | 200 |

-continued

| | | | | | |
|---|---|---|---|---|---|
| 12 | 13 | 0.001586914 | 90.02197802 | 1170.2857 | 1200 |
| 13 | 1 | 0.00012207 | 1170.285714 | 15213.714 | 15000 |
| total | 8192 | 100.00% | 100.00% | 100.00% | 97.76% |
| HEADS/COINS | 14 pay more than: | | 7 multibet | | |
| 0 | 1 | 6.10352E−05 | 0 | 0 | |
| 1 | 14 | 0.000854492 | 0 | 0 | |
| 2 | 91 | 0.005554199 | 0 | 0 | |
| 3 | 364 | 0.022216797 | 0 | 0 | |
| 4 | 1001 | 0.061096191 | 0 | 0 | |
| 5 | 2002 | 0.122192383 | 0 | 0 | |
| 6 | 3003 | 0.183288574 | 0 | 0 | |
| 7 | 3432 | 0.209472656 | 0.596736597 | 8.3543124 | 8 |
| 8 | 3003 | 0.183288574 | 0.681984682 | 9.5477855 | 9 |
| 9 | 2002 | 0.122192383 | 1.022977023 | 14.321678 | 14 |
| 10 | 1001 | 0.061096191 | 2.045954046 | 28.643357 | 28 |
| 11 | 364 | 0.022216797 | 5.626373626 | 78.769231 | 80 |
| 12 | 91 | 0.005554199 | 22.50549451 | 315.07692 | 300 |
| 13 | 14 | 0.000854492 | 146.2857143 | 2048 | 2000 |
| 14 | 1 | 6.10352E−05 | 2048 | 28672 | 30000 |
| total | 16384 | 100.00% | 100.00% | 100.00% | 98.07% |
| HEADS/COINS | 15 pay more than: | | 8 multibet | | |
| 0 | 1 | 3.05176E−05 | 0 | 0 | |
| 1 | 15 | 0.000457764 | 0 | 0 | |
| 2 | 105 | 0.003204346 | 0 | 0 | |
| 3 | 455 | 0.013885498 | 0 | 0 | |
| 4 | 1365 | 0.041656494 | 0 | 0 | |
| 5 | 3003 | 0.091644287 | 0 | 0 | |
| 6 | 5005 | 0.152740479 | 0 | 0 | |
| 7 | 6435 | 0.196380615 | 0 | 0 | |
| 8 | 6435 | 0.196380615 | 0.636519037 | 9.5477855 | 9 |
| 9 | 5005 | 0.152740479 | 0.818381618 | 12.275724 | 12 |
| 10 | 3003 | 0.091644287 | 1.363969364 | 20.45954 | 20 |
| 11 | 1365 | 0.041656494 | 3.000732601 | 45.010989 | 45 |
| 12 | 455 | 0.013885498 | 9.002197802 | 135.03297 | 135 |
| 13 | 105 | 0.003204346 | 39.00952381 | 585.14286 | 600 |
| 14 | 15 | 0.000457764 | 273.0666667 | 4096 | 4000 |
| 15 | 1 | 3.05176E−05 | 4096 | 61440 | 60000 |
| total | 32768 | 100.00% | 100.00% | 100.00% | 98.45% |
| HEADS/COINS | 16 pay more than: | | 8 multibet | | rounded |
| 0 | 1 | 1.52588E−05 | 0 | 0 | |
| 1 | 16 | 0.000244141 | 0 | 0 | |
| 2 | 120 | 0.001831055 | 0 | 0 | |
| 3 | 560 | 0.008544922 | 0 | 0 | |
| 4 | 1820 | 0.027770996 | 0 | 0 | |
| 5 | 4368 | 0.066650391 | 0 | 0 | |
| 6 | 8008 | 0.122192383 | 0 | 0 | |
| 7 | 11440 | 0.174560547 | 0 | 0 | |
| 8 | 12870 | 0.196380615 | 0.565794699 | 9.0527152 | 9 |
| 9 | 11440 | 0.174560547 | 0.636519037 | 10.184305 | 10 |
| 10 | 8008 | 0.122192383 | 0.909312909 | 14.549007 | 14 |
| 11 | 4368 | 0.066650391 | 1.667073667 | 26.673179 | 25 |
| 12 | 1820 | 0.027770996 | 4.000976801 | 64.015629 | 65 |
| 13 | 560 | 0.008544922 | 13.0031746 | 208.05079 | 200 |
| 14 | 120 | 0.001831055 | 60.68148148 | 970.9037 | 1000 |
| 15 | 16 | 0.000244141 | 455.1111111 | 7281.7778 | 7000 |
| 16 | 1 | 1.52588E−05 | 7281.777778 | 116508.44 | 120000 |
| total | 65536 | 100.00% | 100.00% | 100.00% | 98.59% |

With 16 fair spinners, the jackpot can be 7000× the bet. The increased return to the player as they increase their bet size, shown in the graph of FIG. 2, may encourage them to make larger bets.

Greater Detail on NANNON® Slot Game.

Nannon® game is an invented game which is a simplification of backgammon. It is played in turns with dice rolls, and involves cyclical dynamics. In theory a game may last forever, but in practice games always end. The starting roll of a Nannon® game is that both players roll dice (or a die), and the player with the higher roll moves the calculated distance numerically indicated by the difference between the value on the dice (or between the separate die for each player). When the same computer strategy, whether random or expert, is used to play both sides of the game, the outcome is always 50-50, a fair coin. It is clear that using the NANNON® game instead of flipping coins provides a differently animated game with the same paytables as coin-flipping. Here we will demonstrate that several other interpretations of the game-ending of Nannon® game which provide a variety of payout structures.

Nannon® Game with UNFAIR COINS

When one player moves first with a regular die in a Nannon® game involving one checker each on a 6-point board, that player wins 68.11% of the time. This can be considered as a coin which lands on tails 68% of the time, or a spinner as shown in FIG. 3.

With this configuration, fewer coins can be flipped to achieve the goals of a "jackpot." In the case of a slot machine based on "second mover in Nannon® game," the following Pay tables can be determined.

| | Probability | Payout | Multibet | Rounded |
|---|---|---|---|---|
| one game | | | | |
| lose | 0.6811 | | | |
| win | 0.3189 | 3.135779 | 3 | 3 |
| total | | 100.00% | 95.67% | 95.67% |
| two | | | | |
| 0 | 0.463846 | | | |
| 1 | 0.434433 | 1.150926 | 2.301851 | 3 |
| 2 | 0.101721 | 4.915393 | 9.830786 | 6 |
| | | 100.00% | 100.00% | 95.68% |
| three | | | | |
| 0 | 0.315908 | | | |
| 1 | 0.443814 | 0.751066 | 2.253197 | 2 |
| 2 | 0.207836 | 1.603832 | 4.811496 | 5 |
| 3 | 0.032443 | 10.27451 | 30.82353 | 30 |
| total | | 100.00% | 100.00% | 96.67% |
| four | | | | |
| 0 | 0.215153 | | | |
| 1 | 0.40302 | | | |
| 2 | 0.283098 | 1.177449 | 4.709796 | 5 |
| 3 | 0.088382 | 3.771502 | 15.08601 | 16 |
| 4 | 0.010347 | 32.21479 | 128.8591 | 100 |
| total | | 100.00% | 100.00% | 96.61% |
| five | | | | |
| 0 | 0.146533 | | | |
| 1 | 0.343102 | | | |
| 2 | 0.321346 | 0.777979 | 3.889894 | 4 |
| 3 | 0.150484 | 1.661303 | 8.306513 | 8 |
| 4 | 0.035235 | 7.095119 | 35.4756 | 30 |
| 5 | 0.0033 | 75.75489 | 378.7744 | 400 |
| Total | | 100.00% | 100.00% | 97.33% |
| Six | | | | |
| 0 | 0.099798 | | | |
| 1 | 0.280409 | | | |
| 2 | 0.328284 | | | |
| 3 | 0.204978 | 1.219641 | 7.317844 | 7 |
| 4 | 0.071993 | 3.472575 | 20.83545 | 20 |
| 5 | 0.013486 | 18.53841 | 111.2305 | 110 |
| 6 | 0.001053 | 237.5225 | 1425.135 | 1425 |
| Total | | 100.00% | 100.00% | 97.63% |
| Seven | | | | |
| 0 | 0.067969 | | | |
| 1 | 0.222805 | | | |
| 2 | 0.313015 | | | |
| 3 | 0.244305 | 0.818648 | 5.730533 | 6 |
| 4 | 0.114407 | 1.748147 | 12.23703 | 12 |
| 5 | 0.032146 | 6.22168 | 43.55176 | 40 |
| 6 | 0.005018 | 39.85749 | 279.0024 | 275 |
| 7 | 0.000336 | 595.7841 | 4170.489 | 4000 |
| Total | | 100.00% | 100.00% | 97.82% |
| Eight | | | | |
| 0 | 0.046291 | | | |
| 1 | 0.173422 | | | |

-continued

| | Probability | Payout | Multibet | Rounded |
|---|---|---|---|---|
| 2 | 0.284244 | | | |
| 3 | 0.266219 | | | |
| 4 | 0.155836 | 1.283397 | 10.26718 | 10 |
| 5 | 0.058382 | 3.425722 | 27.40578 | 30 |
| 6 | 0.01367 | 14.63063 | 117.0451 | 100 |
| 7 | 0.001829 | 109.3483 | 874.7865 | 850 |
| 8 | 0.000107 | 1868.026 | 14944.21 | 15000 |
| Total | | 100.00% | 100.00% | 97.97% |
| Nine | | | | |
| 0 | 0.031527 | | | |
| 1 | 0.132875 | | | |
| 2 | 0.248898 | | | |
| 3 | 0.271968 | | | |
| 4 | 0.191042 | 0.87241 | 7.851688 | 8 |
| 5 | 0.089464 | 1.862951 | 16.76656 | 17 |
| 6 | 0.02793 | 5.967243 | 53.70519 | 50 |
| 7 | 0.005606 | 29.7325 | 267.5925 | 250 |
| 8 | 0.000656 | 253.9642 | 2285.677 | 2500 |
| 9 | 3.41E−05 | 4880.855 | 43927.7 | 40000 |
| Total | | 100.00% | 100.00% | 98.37% |
| Ten | | | | |
| 0 | 0.021472 | | | |
| 1 | 0.100551 | | | |
| 2 | 0.211894 | | | |
| 3 | 0.26461 | | | |
| 4 | 0.216852 | | | |
| 5 | 0.121861 | 1.367681 | 13.67681 | 14 |
| 6 | 0.047556 | 3.504668 | 35.04668 | 35 |
| 7 | 0.012726 | 13.09682 | 130.9682 | 125 |
| 8 | 0.002235 | 74.57884 | 745.7884 | 750 |
| 9 | 0.000233 | 716.6532 | 7166.532 | 7000 |
| 10 | 1.09E−05 | 15303.47 | 153034.7 | 150000 |
| Total | | 100.00% | 100.00% | 98.99% |

Thus using 10 Nannon® games with a "second player" model, a jackpot of 15,000 times the bet is obtained. The return to the player may be adjusted to encourage larger bets.

Tic Tac Toe and the Trinomial Distribution

Consider the simple game of tic tac toe. When both players choose moves randomly, tic tac toe is turned into a spinner with 3 segments, where player 1 wins, there is a draw, or player 2 wins. Of the 9! Or 362880 possible permutations of the 9 positions, of Player 1 wins 212256 or 59%, there is a draw 12% and Player 2 wins 29% of the time. In FIG. 4 we show that random tic-tac-toe can be viewed as a spinner and thus our invention allows the construction of a tic-tac-toe slot by letting the human play as player 2. Beyond a pure software model, a physical machine could play such a random game of tic-tac-toe by simply permuting 9 numbered marbles into a sequence like a bingo machine, and then considering them the alternating moves of the two players.

The trinomial distribution is much like the binomial one. A table can be constructed by adding up items instead of two. Here in column form are the trinomial coefficients:

| | | | | | | | | | |
|---|---|---|---|---|---|---|---|---|---|
| | | | | | | | | | 1 |
| | | | | | | | | 1 | 9 |
| | | | | | | | 1 | 8 | 45 |
| | | | | | | 1 | 7 | 36 | 156 |
| | | | | | 1 | 6 | 28 | 112 | 414 |
| | | | | 1 | 5 | 21 | 77 | 266 | 882 |
| | | | 1 | 4 | 15 | 50 | 161 | 504 | 1554 |
| | | 1 | 3 | 10 | 30 | 90 | 266 | 784 | 2304 |
| | 1 | 2 | 6 | 16 | 45 | 126 | 357 | 1016 | 2907 |
| | 1 | 3 | 7 | 19 | 51 | 141 | 393 | 1107 | 3139 |
| | 1 | 2 | 6 | 16 | 45 | 126 | 357 | 1016 | 2907 |
| | | 1 | 3 | 10 | 30 | 90 | 266 | 784 | 2304 |

-continued

| | | | | | | |
|---|---|---|---|---|---|---|
| 1 | 4 | 15 | 50 | 161 | 504 | 1554 |
| | 1 | 5 | 21 | 77 | 266 | 882 |
| | | 1 | 6 | 28 | 112 | 414 |
| | | | 1 | 7 | 36 | 156 |
| | | | | 1 | 8 | 45 |
| | | | | | 1 | 9 |
| | | | | | | 1 |

However, instead of simply dividing each by 3^n to get the probabilities of each sum, because the distribution is not fair, we need to sum the odds across all the possible polynomials in the expansion. The following code in a commercial language called Matlab calculates the multinomials for any game covered by this patent. Given a vector for a spinner (a discrete probability distribution which sums to 1, considered to be numbered events 0, 1, 2 . . . ) and the number of spinners desired, it calculates both the multinomial coefficient as well as the probability of attaining a sum of output events. The RADIX subroutine is used to convert numbers to different base arithmetic.

```
function z=spintest(probs,numdice)
n=length(probs);
z=zeros((n-1)*numdice+1,3); %col 1 count col 2 prob
for i=0:(n^numdice)-1
   vec=radix(i,n,numdice);
   s=sum(vec)+1;
   z(s,2)=z(s,2)+1;
   z(s,3)=z(s,3)+prod(probs(vec+1));
end
for i=1:size(z,1)
   z(i,1)=i-1;
end
function z=radix(n,base,digits,v)
if nargin < 3 digits=floor(1+log(n)/log(base));end
if nargin < 4 v=base.^(digits-(1:digits));end
z=zeros(1,digits);
indx=first(find(n>=v));
if indx*n
   powr=v(indx);
   digit=divide(n,powr);
   z(indx)=digit;
   z=z+radix(n-powr*digit,base,digits);
end
```

With this random Tic-Tac-Toe game as the SPINNER, the following tables provide an incrementally increasing player return with exponential possibilities. Using multiple boards per coin in, the player bets 1 through 4 coins to choose how many games (3, 6, 9, or 12) to start, and the machine automatically plays that many random games of tic-tac-toe in parallel. Software judges whether each outcome is a lose, draw, or win for player 2, and the pay table is consulted and the player is rewarded. In this game, we can establish a LOSE=0, Draw=1 and Win=2, and that to be paid, the games return a minimum sum of the number of coins in. With 12 games, a jackpot of 250,000 times the bet of 4 coins can be achieved.

| three | | | raw | multibet | adjusted |
|---|---|---|---|---|---|
| 0 | 1 | 0.200120153911 | | | 0 |
| 1 | 3 | 0.130336056821 | | | 0 |
| 2 | 6 | 0.323995409363 | | | 0 |
| 3 | 7 | 0.130438357589 | 1.916614136 | 1.916614136 | 1 |
| 4 | 6 | 0.159579828492 | 1.566614041 | 1.566614041 | 3 |
| 5 | 3 | 0.031618615700 | 7.906734513 | 7.906734513 | 5 |
| 6 | 1 | 0.023911578123 | 10.45518613 | 10.45518613 | 8 |
| | | 0.345548379905 | 100.00% | 100.00% | 95.86% |

| six | | | raw | two coins | adjusted |
|---|---|---|---|---|---|
| 0 | 1 | 0.040048076001 | | | 0 |
| 1 | 6 | 0.052165743502 | | | 0 |
| 2 | 21 | 0.146663510084 | | | 0 |
| 3 | 50 | 0.136663256562 | | | 0 |
| 4 | 90 | 0.202844947339 | | | 0 |
| 5 | 126 | 0.138775913796 | 0.900732675 | 1.801465349 | 1 |
| 6 | 141 | 0.138232897621 | 0.904270996 | 1.808541992 | 2 |
| 7 | 126 | 0.068352315750 | 1.828760279 | 3.657520557 | 4 |
| 8 | 90 | 0.049208765349 | 2.540197851 | 5.080395702 | 6 |
| 9 | 50 | 0.016329360497 | 7.654923169 | 15.30984634 | 15 |
| 10 | 21 | 0.008631347931 | 14.48209492 | 28.96418984 | 30 |
| 11 | 6 | 0.001512101999 | 82.66638103 | 165.3327621 | 150 |
| 12 | 1 | 0.000571763568 | 218.6218341 | 437.2436683 | 400 |
| | | 0.421614466511 | 100.00% | 100.00% | 97.17% |

| nine games | | | raw | three coins | adjusted |
|---|---|---|---|---|---|
| 0 | 1 | 0.008014427133 | | | 0 |
| 1 | 9 | 0.015659124928 | | | 0 |
| 2 | 45 | 0.049124794299 | | | 0 |
| 3 | 156 | 0.068589882200 | | | 0 |
| 4 | 414 | 0.119119095047 | | | 0 |
| 5 | 882 | 0.127209548065 | | | 0 |
| 6 | 1554 | 0.155309215692 | | | 0 |
| 7 | 2304 | 0.130810288980 | | | 0 |
| 8 | 2907 | 0.121842984401 | 0.75 | 2.238350235 | 2 |
| 9 | 3139 | 0.081685566320 | 1.11 | 3.338744958 | 3 |
| 10 | 2907 | 0.060012216198 | 1.51 | 4.544529264 | 5 |

-continued

| | | | | | |
|---|---|---|---|---|---|
| 11 | 2304 | 0.031733661105 | 2.86 | 8.59425806 | 8 |
| 12 | 1554 | 0.018557293564 | 4.90 | 14.69650042 | 15 |
| 13 | 882 | 0.007486455689 | 12.14 | 36.42942456 | 35 |
| 14 | 414 | 0.003452844906 | 26.33 | 78.98625051 | 75 |
| 15 | 156 | 0.000979252931 | 92.84 | 278.5054444 | 300 |
| 16 | 45 | 0.000345441655 | 263.17 | 789.5031452 | 750 |
| 17 | 9 | 0.000054235118 | 1676.20 | 5028.610331 | 5000 |
| 18 | 1 | 0.000013671769 | 6649.40 | 19948.20627 | 20000 |
| | | 0.326163623656 | 100.00% | 100.00% | 97.98% |
| Twelve | | | raw | 4 coins | adjusted |
| 0 | 1 | 0.001603848391 | | | 0 |
| 1 | 12 | 0.004178275321 | | | 0 |
| 2 | 78 | 0.014468447592 | | | 0 |
| 3 | 352 | 0.026247823067 | | | 0 |
| 4 | 1221 | 0.052015565701 | | | 0 |
| 5 | 3432 | 0.072365557487 | | | 0 |
| 6 | 8074 | 0.103727370280 | | | 0 |
| 7 | 16236 | 0.116046428660 | | | 0 |
| 8 | 28314 | 0.130697384725 | | | 0 |
| 9 | 43252 | 0.120574225461 | | | 0 |
| 10 | 58278 | 0.110850208779 | | | 0 |
| 11 | 69576 | 0.085358174965 | 0.84 | 3.35 | 3 |
| 12 | 73789 | 0.065241753619 | 1.09 | 4.38 | 4 |
| 13 | 69576 | 0.042042086177 | 1.70 | 6.80 | 7 |
| 14 | 58278 | 0.026891485266 | 2.66 | 10.62 | 10 |
| 15 | 43252 | 0.014406944805 | 4.96 | 19.83 | 20 |
| 16 | 28314 | 0.007691719641 | 9.29 | 37.15 | 35 |
| 17 | 16236 | 0.003363779081 | 21.23 | 84.94 | 85 |
| 18 | 8074 | 0.001480908380 | 48.23 | 192.93 | 200 |
| 19 | 3432 | 0.000508868857 | 140.37 | 561.47 | 500 |
| 20 | 1221 | 0.000180155043 | 396.48 | 1,585.94 | 1500 |
| 21 | 352 | 0.000044776024 | 1,595.24 | 6,380.97 | 7000 |
| 22 | 78 | 0.000012156633 | 5,875.69 | 23,502.75 | 25000 |
| 23 | 12 | 0.000001729130 | 41,308.97 | 165,235.89 | 150000 |
| 24 | 1 | 0.000000326914 | 218,493.74 | 873,974.97 | 1000000 |
| | | 0.247224864536 | 100.00% | 100.00% | 98.70% |

These four paytables for random TicTacToe show an increasing player return as more coins are bet and are represented in the graph of FIG. 5.

Multinomial Games

Thus any game played with a random element which has a finite set of outcomes can be turned into a SPINNER, and this spinner can be turned into a slot machine using the method of this patent. We will demonstrate for fair six sided dice, 6-outcome Nannon® game, and then for Poker and Blackjack, for which despite a century of art, this invention leads to new family of slot machines.

The probability of a fair dice coming up each of 6 sides is ⅙th each. Portrayed as a spinner it is shown in FIG. 6.

When two dice are rolled, the multinomial coefficients which count up and down by 1 are familiar to players of craps and backgammon. The multinomial theorem, using a Pascal's triangle adding up 6 previous entries gives the multinomial coefficients, and dividing each by 6ˆn (for n dice) provides the probabilities of each total coming up. From these calculations, we establish a minimum total for payout of (max−min)/2, and we can calculate the raw 100% payback for those paylines. Again, assuming the player bets multiple coins we can round to integer paybacks. Here we can multiply the theoretical payback by the number of coins bet which is also the number of dice thrown, and adjust the paybacks to integer numbers. There is enough flexibility to manage the reinforcement as well as make the return to the player increase with increased bet.

| | Events | Probability | Raw Pay | Multibet | Adjusted |
|---|---|---|---|---|---|
| one | | | | | |
| 1 | 1 | 0.166666666667 | | | |
| 2 | 1 | 0.166666666667 | | | |
| 3 | 1 | 0.166666666667 | | | |
| 4 | 1 | 0.166666666667 | 1 | 1 | 1 |
| 5 | 1 | 0.166666666667 | 2 | 2 | 2 |
| 6 | 1 | 0.166666666667 | 3 | 3 | 3 |
| | | | 100.00% | 100.00% | 100.00% |
| two | | | | | |
| 2 | 1 | 0.027777777778 | | | |
| 3 | 2 | 0.055555555556 | | | |
| 4 | 3 | 0.083333333333 | | | |
| 5 | 4 | 0.111111111111 | | | |
| 6 | 5 | 0.138888888889 | | | |

-continued

| | Events | Probability | Raw Pay | Multibet | Adjusted |
|---|---|---|---|---|---|
| 7 | 6 | 0.166666666667 | 1 | 2.00 | 2.00 |
| 8 | 5 | 0.138888888889 | 1.2 | 2.40 | 2.00 |
| 9 | 4 | 0.111111111111 | 1.5 | 3.00 | 3.00 |
| 10 | 3 | 0.083333333333 | 2 | 4.00 | 4.00 |
| 11 | 2 | 0.055555555556 | 3 | 6.00 | 6.00 |
| 12 | 1 | 0.027777777778 | 6 | 12.00 | 11.00 |
| | 36 | | 100.00% | 100.00% | 95.83% |
| three | | | | | |
| 3 | 1 | 0.004629629630 | | | |
| 4 | 3 | 0.013888888889 | | | |
| 5 | 6 | 0.027777777778 | | | |
| 6 | 10 | 0.046296296296 | | | |
| 7 | 15 | 0.069444444444 | | | |
| 8 | 21 | 0.097222222222 | | | |
| 9 | 25 | 0.115740740741 | | | |
| 10 | 27 | 0.125000000000 | | | |
| 11 | 27 | 0.125000000000 | 1 | 3.00 | 3.00 |
| 12 | 25 | 0.115740740741 | 1.08 | 3.24 | 3.00 |
| 13 | 21 | 0.097222222222 | 1.285714 | 3.86 | 4.00 |
| 14 | 15 | 0.069444444444 | 1.8 | 5.40 | 5.00 |
| 15 | 10 | 0.046296296296 | 2.7 | 8.10 | 8.00 |
| 16 | 6 | 0.027777777778 | 4.5 | 13.50 | 13.00 |
| 17 | 3 | 0.013888888889 | 9 | 27.00 | 25.00 |
| 18 | 1 | 0.004629629630 | 27 | 81.00 | 80.00 |
| | 216 | | 100.00% | 100.00% | 96.91% |
| four | | | | | |
| 4 | 1 | 0.000771604938 | | | |
| 5 | 4 | 0.003086419753 | | | |
| 6 | 10 | 0.007716049383 | | | |
| 7 | 20 | 0.015432098765 | | | |
| 8 | 35 | 0.027006172840 | | | |
| 9 | 56 | 0.043209876543 | | | |
| 10 | 80 | 0.061728395062 | | | |
| 11 | 104 | 0.080246913580 | | | |
| 12 | 125 | 0.096450617284 | | | |
| 13 | 140 | 0.108024691358 | | | |
| 14 | 146 | 0.112654320988 | 0.806974 | 3.23 | 3.00 |
| 15 | 140 | 0.108024691358 | 0.841558 | 3.37 | 3.00 |
| 16 | 125 | 0.096450617284 | 0.942545 | 3.77 | 4.00 |
| 17 | 104 | 0.080246913580 | 1.132867 | 4.53 | 5.00 |
| 18 | 80 | 0.061728395062 | 1.472727 | 5.89 | 6.00 |
| 19 | 56 | 0.043209876543 | 2.103896 | 8.42 | 8.00 |
| 20 | 35 | 0.027006172840 | 3.366234 | 13.46 | 12.00 |
| 21 | 20 | 0.015432098765 | 5.890909 | 23.56 | 21.00 |
| 22 | 10 | 0.007716049383 | 11.78182 | 47.13 | 50.00 |
| 23 | 4 | 0.003086419753 | 29.45455 | 117.82 | 100.00 |
| 24 | 1 | 0.000771604938 | 117.8182 | 471.27 | 500.00 |
| | 1296 | | 100.00% | 100.00% | 97.34% |
| five | | | | | |
| 5 | 1 | 0.000128600823 | | | |
| 6 | 5 | 0.000643004115 | | | |
| 7 | 15 | 0.001929012346 | | | |
| 8 | 35 | 0.004501028807 | | | |
| 9 | 70 | 0.009002057613 | | | |
| 10 | 126 | 0.016203703704 | | | |
| 11 | 205 | 0.026363168724 | | | |
| 12 | 305 | 0.039223251029 | | | |
| 13 | 420 | 0.054012345679 | | | |
| 14 | 540 | 0.069444444444 | | | |
| 15 | 651 | 0.083719135802 | | | |
| 16 | 735 | 0.094521604938 | | | |
| 17 | 780 | 0.100308641975 | | | |
| 18 | 780 | 0.100308641975 | 0.766864 | 3.83 | 3 |
| 19 | 735 | 0.094521604938 | 0.813815 | 4.07 | 4 |
| 20 | 651 | 0.083719135802 | 0.918823 | 4.59 | 5 |
| 21 | 540 | 0.069444444444 | 1.107692 | 5.54 | 6 |
| 22 | 420 | 0.054012345679 | 1.424176 | 7.12 | 7 |
| 23 | 305 | 0.039223251029 | 1.96116 | 9.81 | 10 |
| 24 | 205 | 0.026363168724 | 2.917824 | 14.59 | 15 |
| 25 | 126 | 0.016203703704 | 4.747253 | 23.74 | 20 |
| 26 | 70 | 0.009002057613 | 8.545055 | 42.73 | 40 |
| 27 | 35 | 0.004501028807 | 17.09011 | 85.45 | 80 |

-continued

| | Events | Probability | Raw Pay | Multibet | Adjusted |
|---|---|---|---|---|---|
| 28 | 15 | 0.001929012346 | 39.87692 | 199.38 | 200 |
| 29 | 5 | 0.000643004115 | 119.6308 | 598.15 | 600 |
| 30 | 1 | 0.000128600823 | 598.1538 | 2,990.77 | 3000 |
| | 7776 | | 100.00% | 100.00% | 97.63% |
| six | | | | | |
| 6 | 1 | 0.000021433471 | | | |
| 7 | 6 | 0.000128600823 | | | |
| 8 | 21 | 0.000450102881 | | | |
| 9 | 56 | 0.001200274348 | | | |
| 10 | 126 | 0.002700617284 | | | |
| 11 | 252 | 0.005401234568 | | | |
| 12 | 456 | 0.009773662551 | | | |
| 13 | 756 | 0.016203703704 | | | |
| 14 | 1161 | 0.024884259259 | | | |
| 15 | 1666 | 0.035708161866 | | | |
| 16 | 2247 | 0.048161008230 | | | |
| 17 | 2856 | 0.061213991770 | | | |
| 18 | 3431 | 0.073538237311 | | | |
| 19 | 3906 | 0.083719135802 | | | |
| 20 | 4221 | 0.090470679012 | | | |
| 21 | 4332 | 0.092849794239 | 0.67313 | 4.04 | 3 |
| 22 | 4221 | 0.090470679012 | 0.690832 | 4.14 | 4 |
| 23 | 3906 | 0.083719135802 | 0.746544 | 4.48 | 5 |
| 24 | 3431 | 0.073538237311 | 0.849898 | 5.10 | 6 |
| 25 | 2856 | 0.061213991770 | 1.021008 | 6.13 | 7 |
| 26 | 2247 | 0.048161008230 | 1.29773 | 7.79 | 8 |
| 27 | 1666 | 0.035708161866 | 1.7503 | 10.50 | 10 |
| 28 | 1161 | 0.024884259259 | 2.511628 | 15.07 | 15 |
| 29 | 756 | 0.016203703704 | 3.857143 | 23.14 | 20 |
| 30 | 456 | 0.009773662551 | 6.394737 | 38.37 | 35 |
| 31 | 252 | 0.005401234568 | 11.57143 | 69.43 | 70 |
| 32 | 126 | 0.002700617284 | 23.14286 | 138.86 | 130 |
| 33 | 56 | 0.001200274348 | 52.07143 | 312.43 | 300 |
| 34 | 21 | 0.000450102881 | 138.8571 | 833.14 | 800 |
| 35 | 6 | 0.000128600823 | 486 | 2,916.00 | 3000 |
| 36 | 1 | 0.000021433471 | 2916 | 17,496.00 | 15000 |
| | 46656 | | 100.00% | 100.00% | 97.79% |
| seven | | | | | |
| 7 | 1 | 0.000003572245 | | | |
| 8 | 7 | 0.000025005716 | | | |
| 9 | 28 | 0.000100022862 | | | |
| 10 | 84 | 0.000300068587 | | | |
| 11 | 210 | 0.000750171468 | | | |
| 12 | 462 | 0.001650377229 | | | |
| 13 | 917 | 0.003275748743 | | | |
| 14 | 1667 | 0.005954932556 | | | |
| 15 | 2807 | 0.010027291952 | | | |
| 16 | 4417 | 0.015778606539 | | | |
| 17 | 6538 | 0.023355338363 | | | |
| 18 | 9142 | 0.032657464563 | | | |
| 19 | 12117 | 0.043284893690 | | | |
| 20 | 15267 | 0.054537465706 | | | |
| 21 | 18327 | 0.065468535665 | | | |
| 22 | 20993 | 0.074992141061 | | | |
| 23 | 22967 | 0.082043752858 | | | |
| 24 | 24017 | 0.085794610197 | | | |
| 25 | 24017 | 0.085794610197 | 0.647541 | 4.53 | 3 |
| 26 | 22967 | 0.082043752858 | 0.677145 | 4.74 | 4 |
| 27 | 20993 | 0.074992141061 | 0.740818 | 5.19 | 5 |
| 28 | 18327 | 0.065468535665 | 0.848584 | 5.94 | 6 |
| 29 | 15267 | 0.054537465706 | 1.018668 | 7.13 | 7 |
| 30 | 12117 | 0.043284893690 | 1.283486 | 8.98 | 9 |
| 31 | 9142 | 0.032657464563 | 1.701159 | 11.91 | 12 |
| 32 | 6538 | 0.023355338363 | 2.378709 | 16.65 | 17 |
| 33 | 4417 | 0.015778606539 | 3.520942 | 24.65 | 25 |
| 34 | 2807 | 0.010027291952 | 5.540435 | 38.78 | 40 |
| 35 | 1667 | 0.005954932556 | 9.329334 | 65.31 | 70 |
| 36 | 917 | 0.003275748743 | 16.95965 | 118.72 | 120 |
| 37 | 462 | 0.001650377229 | 33.66234 | 235.64 | 250 |
| 38 | 210 | 0.000750171468 | 74.05714 | 518.40 | 500 |
| 39 | 84 | 0.000300068587 | 185.1429 | 1,296.00 | 1400 |
| 40 | 28 | 0.000100022862 | 555.4286 | 3,888.00 | 4000 |

-continued

| | Events | Probability | Raw Pay | Multibet | Adjusted |
|---|---|---|---|---|---|
| 41 | 7 | 0.000025005716 | 2221.714 | 15,552.00 | 15000 |
| 42 | 1 | 0.000003572245 | 15552 | 108,864.00 | 100000 |
| | 279936 | | 100.00% | 100.00% | 97.99% |
| eight | | | | | |
| 8 | 1 | 0.000000595374 | | | |
| 9 | 8 | 0.000004762993 | | | |
| 10 | 36 | 0.000021433471 | | | |
| 11 | 120 | 0.000071444902 | | | |
| 12 | 330 | 0.000196473480 | | | |
| 13 | 792 | 0.000471536351 | | | |
| 14 | 1708 | 0.001016899101 | | | |
| 15 | 3368 | 0.002005220241 | | | |
| 16 | 6147 | 0.003659765089 | | | |
| 17 | 10480 | 0.006239521414 | | | |
| 18 | 16808 | 0.010007049230 | | | |
| 19 | 25488 | 0.015174897119 | | | |
| 20 | 36688 | 0.021843087944 | | | |
| 21 | 50288 | 0.029940176802 | | | |
| 22 | 65808 | 0.039180384088 | | | |
| 23 | 82384 | 0.049049306508 | | | |
| 24 | 98813 | 0.058830708924 | | | |
| 25 | 113688 | 0.067686899863 | | | |
| 26 | 125588 | 0.074771852614 | | | |
| 27 | 133288 | 0.079356233806 | | | |
| 28 | 135954 | 0.080943501371 | 0.5883 | 4.71 | 3 |
| 29 | 133288 | 0.079356233806 | 0.600067 | 4.80 | 4 |
| 30 | 125588 | 0.074771852614 | 0.636858 | 5.09 | 5 |
| 31 | 113688 | 0.067686899863 | 0.703519 | 5.63 | 6 |
| 32 | 98813 | 0.058830708924 | 0.809425 | 6.48 | 7 |
| 33 | 82384 | 0.049049306508 | 0.97084 | 7.77 | 8 |
| 34 | 65808 | 0.039180384088 | 1.21538 | 9.72 | 10 |
| 35 | 50288 | 0.029940176802 | 1.590473 | 12.72 | 13 |
| 36 | 36688 | 0.021843087944 | 2.180051 | 17.44 | 17 |
| 37 | 25488 | 0.015174897119 | 3.138015 | 25.10 | 25 |
| 38 | 16808 | 0.010007049230 | 4.75855 | 38.07 | 35 |
| 39 | 10480 | 0.006239521414 | 7.631843 | 61.05 | 60 |
| 40 | 6147 | 0.003659765089 | 13.0115 | 104.09 | 100 |
| 41 | 3368 | 0.002005220241 | 23.74754 | 189.98 | 200 |
| 42 | 1708 | 0.001016899101 | 46.8277 | 374.62 | 400 |
| 43 | 792 | 0.000471536351 | 100.987 | 807.90 | 800 |
| 44 | 330 | 0.000196473480 | 242.3688 | 1,938.95 | 2,000 |
| 45 | 120 | 0.000071444902 | 666.5143 | 5,332.11 | 5,000 |
| 46 | 36 | 0.000021433471 | 2221.714 | 17,773.71 | 20,000 |
| 47 | 8 | 0.000004762993 | 9997.714 | 79,981.71 | 80,000 |
| 48 | 1 | 0.000000595374 | 79981.71 | 639,853.71 | 600,000 |
| | 1679616 | | 100.00% | 100.00% | 98.36% |
| nine | | | | | |
| 9 | 1 | 0.000000099229 | | | |
| 10 | 9 | 0.000000893061 | | | |
| 11 | 45 | 0.000004465306 | | | |
| 12 | 165 | 0.000016372790 | | | |
| 13 | 495 | 0.000049118370 | | | |
| 14 | 1287 | 0.000127707762 | | | |
| 15 | 2994 | 0.000297091716 | | | |
| 16 | 6354 | 0.000630501257 | | | |
| 17 | 12465 | 0.001236889861 | | | |
| 18 | 22825 | 0.002264902613 | | | |
| 19 | 39303 | 0.003899998571 | | | |
| 20 | 63999 | 0.006350558699 | | | |
| 21 | 98979 | 0.009821590173 | | | |
| 22 | 145899 | 0.014477416267 | | | |
| 23 | 205560 | 0.020397519433 | | | |
| 24 | 277464 | 0.027532483615 | | | |
| 25 | 359469 | 0.035669760231 | | | |
| 26 | 447669 | 0.044421760688 | | | |
| 27 | 536569 | 0.053243221466 | | | |
| 28 | 619569 | 0.061479230967 | | | |
| 29 | 689715 | 0.068439750514 | | | |
| 30 | 740619 | 0.073490905064 | | | |
| 31 | 767394 | 0.076147762346 | | | |
| 32 | 767394 | 0.076147762346 | 0.570972 | 5.14 | 4 |
| 33 | 740619 | 0.073490905064 | 0.591614 | 5.32 | 5 |
| 34 | 689715 | 0.068439750514 | 0.635278 | 5.72 | 6 |
| 35 | 619569 | 0.061479230967 | 0.707202 | 6.36 | 7 |

-continued

| | Events | Probability | Raw Pay | Multibet | Adjusted |
|---|---|---|---|---|---|
| 36 | 536569 | 0.053243221466 | 0.816597 | 7.35 | 8 |
| 37 | 447669 | 0.044421760688 | 0.97876 | 8.81 | 9 |
| 38 | 359469 | 0.035669760231 | 1.218911 | 10.97 | 11 |
| 39 | 277464 | 0.027532483615 | 1.579162 | 14.21 | 14 |
| 40 | 205560 | 0.020397519433 | 2.131546 | 19.18 | 19 |
| 41 | 145899 | 0.014477416267 | 3.003178 | 27.03 | 27 |
| 42 | 98979 | 0.009821590173 | 4.426805 | 39.84 | 40 |
| 43 | 63999 | 0.006350558699 | 6.846368 | 61.62 | 60 |
| 44 | 39303 | 0.003899998571 | 11.14828 | 100.33 | 100 |
| 45 | 22825 | 0.002264902613 | 19.19653 | 172.77 | 170 |
| 46 | 12465 | 0.001236889861 | 35.15128 | 316.36 | 300 |
| 47 | 6354 | 0.000630501257 | 68.95825 | 620.62 | 600 |
| 48 | 2994 | 0.000297091716 | 146.3463 | 1,317.12 | 1,300 |
| 49 | 1287 | 0.000127707762 | 340.4512 | 3,064.06 | 3,000 |
| 50 | 495 | 0.000049118370 | 885.1731 | 7,966.56 | 8,000 |
| 51 | 165 | 0.000016372790 | 2655.519 | 23,899.67 | 24,000 |
| 52 | 45 | 0.000004465306 | 9736.904 | 87,632.14 | 85,000 |
| 53 | 9 | 0.000000893061 | 48684.52 | 438,160.70 | 400,000 |
| 54 | 1 | 0.000000099229 | 438160.7 | 3,943,446.26 | 4,000,000 |
| | 10077696 | | 100.00% | 100.00% | 98.69% |

In the case of 9 plain dice, we can return a jackpot of over 400,000 times the players bet.

Consideration of a Nannon® Game with Measured Outcomes as a Spinner

The mini-backgammon game modeled before as both a fair coin and a biased coin, can also be used as a multinomial spinner. Consider that when one player wins, the opponent is left on one of the 6 positions of the board. We thus have a 7-way non-increasing probability distribution with a 50% "zero" outcome, which can be used as a SPINNER under this invention. Because Nannon® game is cyclic it is difficult to solve directly like tic tac toe, dice, or poker. Using Monte Carlo methods, we use a computer to play millions of games to arrive at the spinner probabilities. Advanced robotic automation could be used to roll the dice and move the pieces to make a physical random number generator, but this is most likely implemented in software or firmware.

Following earlier derivations, we establish a minimum sum of outcomes, which is one greater than the number of boards, and extract the raw 100% payback for those paylines, multiply it by the multiple bet, and then adjust the values to integers to get the following tables for up to 6 Nannon® games, achieving a nearly 2,000,000 times jackpot potential.

Using these tables, the house edge and player's return increases from 94% to 97% and the reinforcement varies between 35 and 50% of the time when the player receives any payback.

| | count | prob | raw | Multibet | adjusted |
|---|---|---|---|---|---|
| one | | | | | |
| 0 | | 0.5000000000000000 | | | |
| 1 | | 0.1332420000000000 | | | |
| 2 | | 0.1097420000000000 | 1.82 | 1.82 | 1 |
| 3 | | 0.0875080000000000 | 2.29 | 2.29 | 2 |
| 4 | | 0.0681380000000000 | 2.94 | 2.94 | 3 |
| 5 | | 0.0545040000000000 | 3.67 | 3.67 | 4 |
| 6 | | 0.0468660000000000 | 4.27 | 4.27 | 5 |
| | | 100% | 100% | 100% | 94.15% |
| two | | | | | |
| 0 | 1 | 0.2500000000 | | | |
| 1 | 2 | 0.1322000000 | | | |
| 2 | 3 | 0.1286768400 | | | |
| 3 | 4 | 0.1164012800 | 0.86 | 1.72 | 1 |
| 4 | 5 | 0.1030682400 | 0.97 | 1.94 | 2 |
| 5 | 6 | 0.0914486800 | 1.09 | 2.19 | 3 |
| 6 | 7 | 0.0846559600 | 1.18 | 2.36 | 4 |
| 7 | 6 | 0.0364457600 | 2.74 | 5.49 | 5 |
| 8 | 5 | 0.0246225700 | 4.06 | 8.12 | 7 |
| 9 | 4 | 0.0156384800 | 6.39 | 12.79 | 10 |
| 10 | 3 | 0.0093962200 | 10.64 | 21.29 | 18 |
| 11 | 2 | 0.0051706800 | 19.34 | 38.68 | 25 |
| 12 | 1 | 0.0022752900 | 43.95 | 87.90 | 70 |
| | | 100.00% | 100.00% | 100.00% | 95.21% |
| Three games | | | | | |
| 0 | 1 | 0.1250000000 | | | |
| 1 | 3 | 0.0991500000 | | | |
| 2 | 6 | 0.1096152600 | | | |

-continued

| | count | prob | raw | Multibet | adjusted |
|---|---|---|---|---|---|
| 3 | 10 | 0.1116623582 | | | |
| 4 | 15 | 0.1096576338 | 0.61 | 1.82 | 1 |
| 5 | 21 | 0.1059886087 | 0.63 | 1.89 | 2 |
| 6 | 28 | 0.1038072572 | 0.64 | 1.93 | 2 |
| 7 | 33 | 0.0697110194 | 0.96 | 2.87 | 3 |
| 8 | 36 | 0.0539237469 | 1.24 | 3.71 | 4 |
| 9 | 37 | 0.0398218961 | 1.67 | 5.02 | 5 |
| 10 | 36 | 0.0282784100 | 2.36 | 7.07 | 7 |
| 11 | 33 | 0.0191265159 | 3.49 | 10.46 | 10 |
| 12 | 28 | 0.0119070138 | 5.60 | 16.80 | 15 |
| 13 | 21 | 0.0058249752 | 11.44 | 34.33 | 35 |
| 14 | 15 | 0.0033610877 | 19.83 | 59.50 | 60 |
| 15 | 10 | 0.0018032359 | 36.97 | 110.91 | 100 |
| 16 | 6 | 0.0008824877 | 75.54 | 226.63 | 200 |
| 17 | 3 | 0.0003699622 | 180.20 | 540.60 | 500 |
| 18 | 1 | 0.0001085313 | 614.26 | 1,842.79 | 2,000 |
| | | 100.00% | 100.00% | 100.00% | 96.18% |
| four | | | | | |
| 0 | 1 | 0.0625000000 | | | |
| 1 | 4 | 0.0661000000 | | | |
| 2 | 10 | 0.0818152600 | | | |
| 3 | 20 | 0.0922227965 | | | |
| 4 | 35 | 0.0988683476 | | | |
| 5 | 56 | 0.1029318804 | 0.49 | 1.94 | 2 |
| 6 | 84 | 0.1065812598 | 0.47 | 1.88 | 2 |
| 7 | 116 | 0.0881351203 | 0.57 | 2.27 | 2 |
| 8 | 149 | 0.0756466157 | 0.66 | 2.64 | 3 |
| 9 | 180 | 0.0622679312 | 0.80 | 3.21 | 3 |
| 10 | 206 | 0.0494678420 | 1.01 | 4.04 | 4 |
| 11 | 224 | 0.0378226705 | 1.32 | 5.29 | 5 |
| 12 | 231 | 0.0274716775 | 1.82 | 7.28 | 7 |
| 13 | 224 | 0.0180175101 | 2.78 | 11.10 | 11 |
| 14 | 206 | 0.0120836302 | 4.14 | 16.55 | 16 |
| 15 | 180 | 0.0077566606 | 6.45 | 25.78 | 25 |
| 16 | 149 | 0.0047517996 | 10.52 | 42.09 | 40 |
| 17 | 116 | 0.0027466262 | 18.20 | 72.82 | 70 |
| 18 | 84 | 0.0014694127 | 34.03 | 136.11 | 125 |
| 19 | 56 | 0.0007143654 | 69.99 | 279.97 | 300 |
| 20 | 35 | 0.0003620591 | 138.10 | 552.40 | 500 |
| 21 | 20 | 0.0001683338 | 297.03 | 1,188.12 | 1,000 |
| 22 | 10 | 0.0000694942 | 719.48 | 2,877.94 | 3,000 |
| 23 | 4 | 0.0000235296 | 2,124.98 | 8,499.93 | 8,000 |
| 24 | 1 | 0.0000051769 | 9,658.21 | 38,632.83 | 35,000 |
| | | 100.00% | 100.00% | 100.00% | 97.03% |
| five hands | | | | | |
| 0 | 1 | 0.0312500000 | | | |
| 1 | 5 | 0.0413125000 | | | |
| 2 | 15 | 0.0565960500 | | | |
| 3 | 35 | 0.0697151956 | | | |
| 4 | 70 | 0.0807058344 | | | |
| 5 | 126 | 0.0897719084 | | | |
| 6 | 210 | 0.0980185312 | 0.41 | 2.04 | 2 |
| 7 | 325 | 0.0920360144 | 0.43 | 2.17 | 2 |
| 8 | 470 | 0.0858761310 | 0.47 | 2.33 | 2 |
| 9 | 640 | 0.0769338233 | 0.52 | 2.60 | 3 |
| 10 | 826 | 0.0665558800 | 0.60 | 3.00 | 3 |
| 11 | 1,015 | 0.0556097361 | 0.72 | 3.60 | 4 |
| 12 | 1,190 | 0.0446362553 | 0.90 | 4.48 | 5 |
| 13 | 1,330 | 0.0336697248 | 1.19 | 5.94 | 6 |
| 14 | 1,420 | 0.0251013912 | 1.59 | 7.97 | 8 |
| 15 | 1,451 | 0.0180813014 | 2.21 | 11.06 | 11 |
| 16 | 1,420 | 0.0125819908 | 3.18 | 15.90 | 16 |
| 17 | 1,330 | 0.0084282092 | 4.75 | 23.73 | 20 |
| 18 | 1,190 | 0.0054060497 | 7.40 | 37.00 | 37 |
| 19 | 1,015 | 0.0033097644 | 12.09 | 60.43 | 60 |
| 20 | 826 | 0.0019963208 | 20.04 | 100.18 | 100 |
| 21 | 640 | 0.0011527943 | 34.70 | 173.49 | 150 |
| 22 | 470 | 0.0006344188 | 63.05 | 315.25 | 300 |
| 23 | 325 | 0.0003301886 | 121.14 | 605.71 | 450 |
| 24 | 210 | 0.0001613929 | 247.84 | 1,239.21 | 1,000 |
| 25 | 126 | 0.0000744419 | 537.33 | 2,686.66 | 2,000 |
| 26 | 70 | 0.0000337214 | 1,186.19 | 5,930.95 | 6,000 |
| 27 | 35 | 0.0000138395 | 2,890.29 | 14,451.43 | 14,000 |
| 28 | 15 | 0.0000049407 | 8,096.09 | 40,480.46 | 40,000 |
| 29 | 5 | 0.0000014030 | 28,511.31 | 142,556.55 | 150,000 |

-continued

| | count | prob | raw | Multibet | adjusted |
|---|---|---|---|---|---|
| 30 | 1 | 0.0000002469 | 161,982.50 | 809,912.50 | 1,000,000 |
| | | 100.00% | 100.00% | 100.00% | 97.42% |
| six | | | | | |
| 0 | 1 | 0.0156250000 | | | |
| 1 | 6 | 0.0247875000 | | | |
| 2 | 21 | 0.0372345375 | | | |
| 3 | 56 | 0.0496522956 | | | |
| 4 | 126 | 0.0615725593 | | | |
| 5 | 252 | 0.0727220578 | | | |
| 6 | 462 | 0.0834781378 | | | |
| 7 | 786 | 0.0857379317 | 0.39 | 2.33 | 2 |
| 8 | 1,251 | 0.0857570235 | 0.39 | 2.33 | 2 |
| 9 | 1,876 | 0.0823589824 | 0.40 | 2.43 | 2 |
| 10 | 2,667 | 0.0763563108 | 0.44 | 2.62 | 3 |
| 11 | 3,612 | 0.0684553825 | 0.49 | 2.92 | 3 |
| 12 | 4,676 | 0.0592416413 | 0.56 | 3.38 | 4 |
| 13 | 5,796 | 0.0489629636 | 0.68 | 4.08 | 4 |
| 14 | 6,891 | 0.0395753696 | 0.84 | 5.05 | 5 |
| 15 | 7,872 | 0.0310283334 | 1.07 | 6.45 | 6 |
| 16 | 8,652 | 0.0236125218 | 1.41 | 8.47 | 9 |
| 17 | 9,156 | 0.0174232154 | 1.91 | 11.48 | 12 |
| 18 | 9,331 | 0.0124428374 | 2.68 | 16.07 | 15 |
| 19 | 9,156 | 0.0085920574 | 3.88 | 23.28 | 20 |
| 20 | 8,652 | 0.0057992619 | 5.75 | 34.49 | 35 |
| 21 | 7,872 | 0.0037936946 | 8.79 | 52.72 | 50 |
| 22 | 6,891 | 0.0024025086 | 13.87 | 83.25 | 80 |
| 23 | 5,796 | 0.0014699396 | 22.68 | 136.06 | 125 |
| 24 | 4,676 | 0.0008675966 | 38.42 | 230.52 | 200 |
| 25 | 3,612 | 0.0004945890 | 67.40 | 404.38 | 400 |
| 26 | 2,667 | 0.0002740313 | 121.64 | 729.84 | 700 |
| 27 | 1,876 | 0.0001454244 | 229.21 | 1,375.29 | 1,400 |
| 28 | 1,251 | 0.0000736105 | 452.83 | 2,717.00 | 2,500 |
| 29 | 786 | 0.0000353645 | 942.56 | 5,655.38 | 5,500 |
| 30 | 462 | 0.0000160785 | 2,073.16 | 12,438.97 | 12,000 |
| 31 | 252 | 0.0000069340 | 4,807.23 | 28,843.37 | 30,000 |
| 32 | 126 | 0.0000028426 | 11,726.32 | 70,357.89 | 75,000 |
| 33 | 56 | 0.0000010444 | 31,916.58 | 191,499.48 | 200,000 |
| 34 | 21 | 0.0000003284 | 101,493.85 | 608,963.10 | 800,000 |
| 35 | 6 | 0.0000000803 | 415,084.31 | 2,490,505.83 | 2,500,000 |
| 36 | 1 | 0.0000000118 | 2,829,882.94 | 16,979,297.64 | 10,000,000 |
| | | 1.0000000000 | 100.00% | 100.00% | 97.62% |

Multinomial Random Play Othello® Game

Similar to the construction of a TicTacToe slot, Othello® game, or Reversi® game is a well loved board game. There have been attempts to convert it to a slot machine, e.g. (http://www.ledgaming.com/Othello/html/). Under our invention, the slots depend on how the games end up, so we ran 1,200,000 random games on a 4 by 4 board and collected the following statistics of outcomes, where a −16 means player 2 captured the entire board and +16 means Player 1 captured the entire board, and 0 means a tie. In Othello-4, player 2 has a great advantage winning 55% of the time, while player 1 wins only 35% of the time with 9% being a draw. In a mode exactly like our tic-tac-toe, we can use lose, draw, and win as outcomes 0 1 and 2, and derive a multinomial. However, there are many more paylines available.

| | | |
|---|---|---|
| −16 | 35685 | 0.029738 |
| −15 | 3575 | 0.002979 |
| −14 | 32601 | 0.027168 |
| −13 | 1631 | 0.001359 |
| −12 | 34907 | 0.029089 |
| −11 | 8292 | 0.00691 |
| −10 | 72193 | 0.060161 |
| −9 | 16131 | 0.013443 |
| −8 | 96486 | 0.080405 |
| −7 | 3642 | 0.003035 |

-continued

| | | |
|---|---|---|
| −6 | 90111 | 0.075093 |
| −5 | 5919 | 0.004933 |
| −4 | 121885 | 0.101571 |
| −3 | 9085 | 0.007571 |
| −2 | 124529 | 0.103774 |
| −1 | 5413 | 0.004511 |
| 0 | 116600 | 0.097167 |
| 1 | 8328 | 0.00694 |
| 2 | 104138 | 0.086782 |
| 3 | 9643 | 0.008036 |
| 4 | 68290 | 0.056908 |
| 5 | 11002 | 0.009168 |
| 6 | 39365 | 0.032804 |
| 7 | 5630 | 0.004692 |
| 8 | 46065 | 0.038388 |
| 9 | 11750 | 0.009792 |
| 10 | 38273 | 0.031894 |
| 11 | 6439 | 0.005366 |
| 12 | 16405 | 0.013671 |
| 13 | 10646 | 0.008872 |
| 14 | 26086 | 0.021738 |
| 15 | 8979 | 0.007483 |
| 16 | 10276 | 0.008563 |
| | 1200000 | 100.00% |

There are 33 different outcomes, or 3 different outcomes, so by recombining we get a reduced set of outcomes for this game. Odd number outcomes are much rarer than even numbered outcomes. Therefore we sort the Player-1 wins by decreasing likelihood and we find that it is more common to win by low even numbers, high even numbers then by odd numbers, and that winning by 1, 7, and 15, are the rarest forms of win for player 1. Using the decreased sorted table, with the "16" line moved up to the evens, provides a reduced outcomes tables as follows and a gives a pie chart with 35% reinforcement, as shown in FIG. 8.

| | | | | |
|---|---|---|---|---|
| 2 | 104138 | 8.68% | | |
| 4 | 68290 | 5.69% | | |
| 8 | 46065 | 3.84% | | |
| 6 | 39365 | 3.28% | 0.21488 | 2-4-6-8 |
| 10 | 38273 | 3.19% | | |
| 14 | 26086 | 2.17% | | |
| 12 | 16405 | 1.37% | | |

-continued

| | | | | |
|---|---|---|---|---|
| 16 | 10276 | 0.86% | 0.07587 | 10-12-14-16 |
| 9 | 11750 | 0.98% | | |
| 5 | 11002 | 0.92% | | |
| 13 | 10646 | 0.89% | | |
| 3 | 9643 | 0.80% | | |
| 15 | 8979 | 0.75% | 0.04335 | 3-5-9-13-15 |
| 1 | 8328 | 0.69% | 0.00694 | 1 |
| 11 | 6439 | 0.54% | 0.00537 | 11 |
| 7 | 5630 | 0.47% | 0.00469 | 7 |

Using this spinner, we can derive a 4 coin multinomial slot machine for Othello-4 with random legal play to have a potential $100,000,000 jackpot if all four games are won by player 1 with a 7 point lead. As in other games shown, the player return can be slightly increased with increased bets as an incentive.

| | prob | raw | multibet | adjusted |
|---|---|---|---|---|
| one game | | | | |
| 0 | 0.64890416667 | | | |
| 1 | 0.21488166667 | 0.77562069 | 0.77562069 | 1 |
| 2 | 0.07586666667 | 2.196836555 | 2.196836555 | 2 |
| 3 | 0.04335000000 | 3.844675125 | 3.844675125 | 3 |
| 4 | 0.00694000000 | 24.01536984 | 24.01536984 | 20 |
| 5 | 0.00536583333 | 31.06072371 | 31.06072371 | 30 |
| 6 | 0.00469166667 | 35.52397869 | 35.52397869 | 35 |
| | 100.00% | 100.00% | 100.00% | 96.06% |
| two games | | | | |
| 0 | 0.42107661795 | | | |
| 1 | 0.27887522215 | | | |
| 2 | 0.14463452870 | 0.628543486 | 1.257086973 | 1 |
| 3 | 0.08886470477 | 1.023005603 | 2.046011206 | 2 |
| 4 | 0.03339278224 | 2.722417385 | 5.44483477 | 5 |
| 5 | 0.01652401676 | 5.501633908 | 11.00326782 | 10 |
| 6 | 0.01132717733 | 8.025749776 | 16.05149955 | 15 |
| 7 | 0.00343218108 | 26.48726535 | 52.97453069 | 50 |
| 8 | 0.00122526382 | 74.19552378 | 148.3910476 | 150 |
| 9 | 0.00048124551 | 188.9037698 | 377.8075395 | 400 |
| 10 | 0.00009391251 | 968.0189546 | 1936.037909 | 2000 |
| 11 | 0.00005034941 | 1805.564272 | 3611.128545 | 3500 |
| 12 | 0.00002201177 | 4130.022333 | 8260.044666 | 9000 |
| | 100.00% | 100.00% | 100.00% | 96.73% |
| Three game | | | | |
| 0 | 0.27323837201 | | | |
| 1 | 0.27144494059 | | | |
| 2 | 0.18572480264 | | | |
| 3 | 0.12815499213 | 0.487690717 | 1.463072151 | 1 |
| 4 | 0.06674856438 | 0.936349726 | 2.809049179 | 3 |
| 5 | 0.03510459579 | 1.780393666 | 5.341180999 | 5 |
| 6 | 0.02176235823 | 2.871931403 | 8.61579421 | 8 |
| 7 | 0.01006355448 | 6.210529305 | 18.63158791 | 20 |
| 8 | 0.00449541924 | 13.90304145 | 41.70912435 | 50 |
| 9 | 0.00203777078 | 30.67077058 | 92.01231174 | 100 |
| 10 | 0.00073003638 | 85.61217131 | 256.8365139 | 250 |
| 11 | 0.00030460198 | 205.1857992 | 615.5573975 | 600 |
| 12 | 0.00013315272 | 469.3858167 | 1408.15745 | 1,500 |
| 13 | 0.00003863794 | 1617.581197 | 4852.743592 | 4,500 |
| 14 | 0.00001283517 | 4869.431369 | 14608.29411 | 15,000 |
| 15 | 0.00000406540 | 15373.64592 | 46120.93775 | 45,000 |
| 16 | 0.00000086353 | 72376.95462 | 217130.8639 | 200,000 |
| 17 | 0.00000035433 | 176387.1484 | 529161.4452 | 500,000 |
| 18 | 0.00000010327 | 605198.2228 | 1815594.668 | 1,500,000 |
| | 100.00% | 100.00% | 100.00% | 97.57% |
| Four games | | | | |
| — | 0.17730551818 | | | |
| 1 | 0.23485567075 | | | |
| 2 | 0.19957582590 | | | |
| 3 | 0.15550767133 | | | |
| 4 | 0.09860531508 | 0.48 | 1.931703076 | 2 |
| 5 | 0.05824640270 | 0.82 | 3.270179473 | 3 |

-continued

| | prob | raw | multibet | adjusted |
|---|---|---|---|---|
| 6 | 0.03631193113 | 1.31 | 5.245553859 | 5 |
| 7 | 0.01992292681 | 2.39 | 9.560653024 | 10 |
| 8 | 0.01027464397 | 4.63 | 18.53847112 | 20 |
| 9 | 0.00519823601 | 9.16 | 36.64246679 | 40 |
| 10 | 0.00234146911 | 20.34 | 81.34900846 | 100 |
| 11 | 0.00105531760 | 45.12 | 180.4918167 | 200 |
| 12 | 0.00048287887 | 98.61 | 394.4595708 | 400 |
| 13 | 0.00019391927 | 245.56 | 982.2447588 | 1000 |
| 14 | 0.00007702954 | 618.19 | 2472.768131 | 2500 |
| 15 | 0.00002969134 | 1,603.80 | 6415.210986 | 6000 |
| 16 | 0.00001006626 | 4,730.56 | 18922.24134 | 20000 |
| 17 | 0.00000369203 | 12,897.78 | 51591.12765 | 50000 |
| 18 | 0.00000130601 | 36,461.43 | 145845.7339 | 150000 |
| 19 | 0.00000036487 | 130,509.88 | 522039.5014 | 500000 |
| 20 | 0.00000011122 | 428,148.54 | 1712594.171 | 2000000 |
| 21 | 0.00000003064 | 1,553,993.96 | 6215975.824 | 6000000 |
| 22 | 0.00000000667 | 7,139,904.60 | 28559618.39 | 25000000 |
| 23 | 0.00000000222 | 21,483,321.74 | 85933286.96 | 75000000 |
| 24 | 0.00000000048 | 98,281,296.25 | 393125185 | 100000000 |
| | 1.00000002800 | 100.00% | 100.00% | 98.03% |

Multinomial Poker

A poker hand, drawn from a full 52 card deck has a stable distribution of hands which may be used as a SPINNER for this invention. Many varieties of card shuffling machines exist, and single card shufflers can be employed to each mix a deck of cards, and then deal out a hand, which can be read by a computer sensor using vision or a bar code scanner.

Here we show 3 new, simple, pure-luck poker machines, for 5-card, 3-card and 2-card varieties of poker. The history of poker machines leading to the modern "video poker" slots is interesting and never arrived upon our invention. Initially 10 cards were placed on 5 reels, using up 50 of the 52 cards. The reels were spun and a cam mechanism inside "read" the hand and paid out. Stud poker 5 reel machines were improved to allow "draw" poker by holding reels and re-spinning, and these evolved into the modern video poker machine, which involve a hold cycle. Multi-hand video poker games of up to 100 hands drawn from different remainder decks are more complex than our machine below, which require no "draw" or strategy.

First consider drawing 2 cards from a deck of 52. Out of 1326 hands, the following table is derived:

| | | |
|---|---|---|
| nothing | 792 | 0.597285 |
| flush | 264 | 0.199095 |
| straight | 144 | 0.108597 |
| pair | 78 | 0.058824 |
| sflush | 48 | 0.036199 |
| total | 1326 | |

This may be viewed as a 5-way spinner with non-increasing probabilities for our invention as shown in FIG. 9.

Following earlier constructions, we calculate the multinomial probabilities for sums of multiple spinners, and arrive at a set of pay tables as below for the basis of a slot machine. The machine would deal out between 1 and 5 hands of "two-card poker" and then pay the player an exponentially increasing amount as the sum of the hands increases. As can be seen, betting 5 coins can trigger a payment of 5 million coins back, a 1 million times return on the bet.

| One Hand | Count | Probability | T-payoff | | adjusted |
|---|---|---|---|---|---|
| 0-nothing | 792 | 0.597285 | | 0 | |
| 1-flush | 264 | 0.199095 | 1.255682 | 1 | 1 |
| 2-straight | 144 | 0.108597 | 2.302083 | 2 | 2 |
| 3-pair | 78 | 0.058824 | 4.25 | 4 | 5 |
| 4-sflush | 48 | 0.036199 | 6.90625 | 9 | 8 |
| total | 1326 | | 100.00% | 97.74% | 100.00% |

| two hands | Probability | t-payoff | multibet | adjusted |
|---|---|---|---|---|
| 0 | 0.356749 | | | 0 |
| 1 | 0.237833 | | | 0 |
| 2 | 0.169366 | 0.843482 | 1.686965 | 2 |
| 3 | 0.113511 | 1.258529 | 2.517058 | 3 |
| 4 | 0.078459 | 1.820795 | 3.64159 | 4 |
| 5 | 0.02719 | 5.25398 | 10.50796 | 9 |
| 6 | 0.011322 | 12.61715 | 25.23431 | 20 |
| 7 | 0.004259 | 33.54464 | 67.08929 | 55 |
| 8 | 0.00131 | 109.0201 | 218.0402 | 200 |
| | | 100.00% | 100.00% | 98.03% |

-continued

| three hands | Probability | t-payoff | multibet | adjusted |
|---|---|---|---|---|
| 0 | 0.213081 | | | 0 |
| 1 | 0.213081 | | | 0 |
| 2 | 0.187253 | | | 0 |
| 3 | 0.148332 | 0.674165 | 2.022494 | 2 |
| 4 | 0.114759 | 0.871395 | 2.614184 | 3 |
| 5 | 0.06276 | 1.593369 | 4.780106 | 5 |
| 6 | 0.033505 | 2.984665 | 8.953994 | 9 |
| 7 | 0.016475 | 6.069832 | 18.2095 | 20 |
| 8 | 0.0073 | 13.69918 | 41.09755 | 40 |
| 9 | 0.002374 | 42.12896 | 126.3869 | 100 |
| 10 | 0.000803 | 124.5829 | 373.7487 | 400 |
| 11 | 0.000231 | 432.4464 | 1297.339 | 1000 |
| 12 | 4.74E−05 | 2108.176 | 6324.528 | 6000 |
| | | 100.00% | 100.00% | 98.40% |

| Four hands | Probability | t-payoff | multibet | adjusted |
|---|---|---|---|---|
| 0 | 0.12727 | | | 0 |
| 1 | 0.169694 | | | 0 |
| 2 | 0.177407 | | | 0 |
| 3 | 0.161552 | | | 0 |
| 4 | 0.138658 | 0.554767 | 2.219067 | 2 |
| 5 | 0.09517 | 0.808269 | 3.233074 | 3 |
| 6 | 0.060473 | 1.272018 | 5.08807 | 5 |
| 7 | 0.035446 | 2.170125 | 8.6805 | 9 |
| 8 | 0.019125 | 4.022223 | 16.08889 | 18 |
| 9 | 0.008903 | 8.640189 | 34.56076 | 35 |
| 10 | 0.003927 | 19.5898 | 78.35921 | 75 |
| 11 | 0.001581 | 48.64017 | 194.5607 | 200 |
| 12 | 0.000565 | 136.0484 | 544.1935 | 500 |
| 13 | 0.000168 | 458.7024 | 1834.81 | 1450 |
| 14 | 4.78E−05 | 1608.933 | 6435.734 | 6000 |
| 15 | 1.12E−05 | 6892.114 | 27568.46 | 30000 |
| 16 | 1.72E−06 | 44798.74 | 179195 | 200000 |
| | | 100.00% | 100.00% | 98.55% |

| bet 5 | Probability | t-payoff | multibet | adjusted |
|---|---|---|---|---|
| 0 | 0.076017 | | | 0 |
| 1 | 0.126694 | | | 0 |
| 2 | 0.153569 | | | 0 |
| 3 | 0.157728 | | | 0 |
| 4 | 0.148838 | | | 0 |
| 5 | 0.118572 | 0.527104 | 2.635519 | 3 |
| 6 | 0.086051 | 0.726317 | 3.631583 | 4 |
| 7 | 0.057551 | 1.08599 | 5.429952 | 5 |
| 8 | 0.035665 | 1.752429 | 8.762147 | 9 |
| 9 | 0.019977 | 3.128614 | 15.64307 | 15 |
| 10 | 0.010469 | 5.970056 | 29.85028 | 30 |
| 11 | 0.005101 | 12.25176 | 61.25881 | 60 |
| 12 | 0.002295 | 27.23318 | 136.1659 | 125 |
| 13 | 0.000938 | 66.64982 | 333.2491 | 300 |
| 14 | 0.000359 | 174.3296 | 871.6482 | 900 |
| 15 | 0.000125 | 500.3853 | 2501.926 | 2500 |
| 16 | 3.88E−05 | 1612.005 | 8060.026 | 7000 |
| 17 | 1.04E−05 | 5988.451 | 29942.25 | 30000 |
| 18 | 2.57E−06 | 24284.3 | 121421.5 | 120000 |
| 19 | 5.05E−07 | 123756.5 | 618782.6 | 600000 |
| 20 | 6.22E−08 | 1005522 | 5027609 | 5000000 |
| | | 100.00% | 100.00% | 98.77% |

These 5 games, which allow the player to choose how many decks to play on, can be arranged to encourage larger bets.

Three-Card Poker

Three-Card poker has 22,100 different hands, in which three-of-a-kind is a rarer hand than the straight or flush. Counting the hands results in the following table and the spinner shown in

| | |
|---|---|
| 0 - nothing | 16500 |
| 1 - pair | 3744 |
| 2 - flush | 1100 |

-continued

| | |
|---|---|
| 3 - straight | 660 |
| 4 - three-kind | 52 |
| 5 - str-flush | 44 |
| Total Hand | 22100 |

We can build a slot machine which uses 3 hands of 3-card poker to generate a large jackpot as follows.

| | | | | |
|---|---|---|---|---|
| 0 - nothing | 16500 | 74.66% | | |
| 1 - pair | 3744 | 16.94% | 1.18 | 1 |
| 2 - flush | 1100 | 4.98% | 4.02 | 4 |
| 3 - straight | 660 | 2.99% | 6.70 | 7 |
| 4 - three-kind | 52 | 0.24% | 85.00 | 80 |
| 5 - str-flush | 44 | 0.20% | 100.45 | 100 |
| Total Hand | 22100 | 100.00% | 100.00% | 96.49% |

| two games | probability | t-payoff | multibet | adjusted |
|---|---|---|---|---|
| 0 | 0.557421 | | | |
| 1 | 0.252968 | 0.395307238 | 0.790614477 | 1 |
| 2 | 0.103023 | 0.970655632 | 1.941311264 | 2 |
| 3 | 0.061458 | 1.627122156 | 3.254244313 | 3 |
| 4 | 0.01611 | 6.207486584 | 12.41497317 | 12 |
| 5 | 0.006743 | 14.83007194 | 29.66014388 | 30 |
| 6 | 0.001801 | 55.53446058 | 111.0689212 | 100 |
| 7 | 0.000339 | 295.2188397 | 590.4376794 | 600 |
| 8 | 0.000124 | 803.5174757 | 1607.034951 | 1200 |
| 9 | 9.37E−06 | 10673.29747 | 21346.59494 | 18000 |
| 10 | 3.96E−06 | 25227.79499 | 50455.58998 | 50000 |
| | | 100.00% | 100.00% | 96.92% |

| 3 games | t-payoff | multibet | adjusted | bet 3 |
|---|---|---|---|---|
| 0 | 0.416174 | | | |
| 1 | 0.283301 | 0.24 | 0.71 | 1 |
| 2 | 0.147518 | 0.45 | 1.36 | 2 |
| 3 | 0.092577 | 0.72 | 2.16 | 3 |
| 4 | 0.036433 | 1.83 | 5.49 | 6 |
| 5 | 0.015604 | 4.27 | 12.82 | 14 |
| 6 | 0.00587 | 11.36 | 34.07 | 40 |
| 7 | 0.001724 | 38.66 | 115.98 | 120 |
| 8 | 0.000602 | 110.82 | 332.46 | 333 |
| 9 | 0.000147 | 454.58 | 1,363.75 | 1200 |
| 10 | 3.85E−05 | 1,730.74 | 5,192.22 | 5000 |
| 11 | 9.24E−06 | 7,217.63 | 21,652.89 | 20000 |
| 12 | 1.44E−06 | 46,157.54 | 138,472.62 | 120000 |
| 13 | 3.88E−07 | 171,731.55 | 515,194.65 | 500000 |
| 14 | 2.80E−08 | 2,382,625.26 | 7,147,875.78 | 1000000 |
| 15 | 7.89E−09 | 8,447,489.89 | 25,342,469.67 | 5000000 |
| | | 100.00% | 100.00% | 97.45% |

We note that the probabilities in this spinner are so small, that getting 3 3-card straight flushes invokes a $25 m payoff.

Using 5-Card Poker as a Spinner

We consider the natural probability of the hands in 5-card stud poker drawn from a full deck, which are well known. We can reduce from 11 outcomes to 9 by combining the Straight Flush and Royal Flush and ignoring the jacks-or-better pair distinction leading to a spinner as shown in figure.

| | |
|---|---|
| Royal flush | 4 |
| Straight Flush | 36 |
| 4-kind | 624 |
| Full House | 3744 |
| Flush | 5108 |
| Straight | 10200 |
| 3-Kind | 54912 |
| Two-pair | 123552 |
| Jack-Ace Pair | 337920 |
| 2-10 Pair | 760320 |
| Busted | 1302540 |
| Total hands | 2598960 |

Following our earlier derivations, we replicate the spinner, calculate the multinomial expansion, then choose the minimum sum (1 pair) to pay on, providing a number of theoretical paylines 1/probability/number-of-lines to get a raw 100% return with fractional values. Consider two hands of 5-card poker below, where at least one pair must be received. According to this, with a $2 Bet, one pair might return 30 c, while two straight flushes could pay ½ a Billion dollars!

| | | | |
|---|---|---|---|
| 0 | 1 | 0.251178780291249000000000 | t-payoff |
| 1 | 2 | 0.423564088115623000000000 | 0.15 |
| 2 | 3 | 0.226215543009151000000000 | 0.28 |
| 3 | 4 | 0.061355235602413500000000 | 1.02 |
| 4 | 5 | 0.024050304807631700000000 | 2.60 |
| 5 | 6 | 0.007295749557770070000000 | 8.57 |
| 6 | 7 | 0.003924563268838790000000 | 15.93 |
| 7 | 8 | 0.001810857134431940000000 | 34.51 |
| 8 | 9 | 0.000453763098823709000000 | 137.74 |
| 9 | 8 | 0.000112136488882404000000 | 557.36 |
| 10 | 7 | 0.000026779348187937500000 | 2,333.89 |
| 11 | 6 | 0.000008197572130708410000 | 7,624.21 |
| 12 | 5 | 0.000003139836810861780000 | 19,905.49 |
| 13 | 4 | 0.000000752251384889702000 | 83,083.93 |
| 14 | 3 | 0.000000101989267403332000 | 612,809.58 |
| 15 | 2 | 0.000000007390526623429870 | 8,456,772.19 |
| 16 | 1 | 0.000000000236875853315060 | 263,851,292.25 |
| | | | 100.00% |

We can further reduce from 9 to 7 outcomes by combining the fullhouse, 4-of-a-kind, straight-flush and royal flush into a single top category (called royalty). Here are the derived multinomial pay tables for that condensed game with only 7 outcomes per spinner.

| | | | raw | multibet | adjusted |
|---|---|---|---|---|---|
| one hand | | | | | |
| Busted | 1 | 0.501177394034537000 | | | |
| Pair | 1 | 0.422569027611044000 | 0.39 | 0.39 | 1 |
| 2Pair | 1 | 0.047539015606242500 | 3.51 | 3.51 | 2 |
| 3Kind | 1 | 0.021128451380552200 | 7.89 | 7.89 | 5 |
| Straigh | 1 | 0.003924646781789640 | 42.47 | 42.47 | 20 |
| Flush | 1 | 0.001965401545233480 | 84.80 | 84.80 | 50 |
| Royalty | 1 | 0.001696063040600860 | 98.27 | 98.27 | 100 |
| (Full house, 4k, or strflush) | | | 100.00% | 100.00% | 96.97% |
| two hands | | | | | |
| 0 | 1 | 0.251178780291249000 | | | |
| 1 | 2 | 0.423564088115623000 | | | |
| 2 | 3 | 0.226215543009151000 | 0.40 | 0.80 | 1 |
| 3 | 4 | 0.061355235602413500 | 1.48 | 2.96 | 2 |
| 4 | 5 | 0.024050304807631700 | 3.78 | 7.56 | 8 |
| 5 | 6 | 0.007295749557770070 | 12.46 | 24.92 | 25 |
| 6 | 7 | 0.004180651696239700 | 21.75 | 43.49 | 40 |
| 7 | 6 | 0.001786117346560010 | 50.90 | 101.80 | 100 |

-continued

| | | | raw | multibet | adjusted |
|---|---|---|---|---|---|
| 8 | 5 | 0.000259712969057858 | 350.04 | 700.07 | 700 |
| 9 | 4 | 0.000087097384682223 | 1,043.76 | 2,087.53 | 2000 |
| 10 | 3 | 0.000017175699942019 | 5,292.89 | 10,585.78 | 10000 |
| 11 | 2 | 0.000006666889841621 | 13,635.91 | 27,271.81 | 25000 |
| 12 | 1 | 0.000002876629837692 | 31,602.64 | 63,205.28 | 65000 |
| | | | 100.00% | 100.00% | 97.55% |
| three hands | | | | | |
| 0 | 1 | 0.125885126543142000 | | | |
| 1 | 3 | 0.318421118832604000 | | | |
| 2 | 6 | 0.304299973137634000 | | | |
| 3 | 10 | 0.151784377571857000 | 0.41 | 1.24 | 1 |
| 4 | 15 | 0.058669396800093000 | 1.07 | 3.20 | 3 |
| 5 | 21 | 0.023671736870242800 | 2.64 | 7.92 | 8 |
| 6 | 28 | 0.009764179508745600 | 6.40 | 19.20 | 20 |
| 7 | 33 | 0.004920547408068560 | 12.70 | 38.11 | 40 |
| 8 | 36 | 0.001836464543345060 | 34.03 | 102.10 | 100 |
| 9 | 37 | 0.000506602947298249 | 123.37 | 370.11 | 400 |
| 10 | 36 | 0.000167034613875549 | 374.17 | 1,122.52 | 1250 |
| 11 | 33 | 0.000047827660247848 | 1,306.78 | 3,920.33 | 4000 |
| 12 | 28 | 0.000018536040017160 | 3,371.81 | 10,115.43 | 10000 |
| 13 | 21 | 0.000005777042353564 | 10,818.68 | 32,456.05 | 30000 |
| 14 | 15 | 0.000000956692666552 | 65,329.23 | 195,987.70 | 200000 |
| 15 | 10 | 0.000000268423723726 | 232,840.82 | 698,522.46 | 700000 |
| 16 | 6 | 0.000000053523941500 | 1,167,701.75 | 3,503,105.24 | 3000000 |
| 17 | 3 | 0.000000016961198184 | 3,684,881.18 | 11,054,643.54 | 10000000 |
| 18 | 1 | 0.000000004878945549 | 12,810,145.01 | 38,430,435.04 | 35000000 |
| | | | 1.00 | 1.00 | 97.82% |

Under this invention 3 hands of 5 card stud poker with the 3 rarest hands combined can be used to provide over a million times return on a 3 coin bet offering a $35 m jackpot on a $3 bet.

Multinomial Blackjack

While blackjack is the most popular table-game, it has not translated to video format very well. It is too slow, and the payoffs are not high enough. The value of the table game is often in the camaraderie of the table, not the mechanics of playing.

Our invention of a multinomial pure-luck way of converting outcomes into spinners, and spinners into slots provides a fun version of multi-hand blackjack. It is different from poker in that each hand can range from 2 cards to 5 cards. In order to remove the skill element, the player automatically stands on 17. To create the spinner, we ran a program over all exhaustive hands of 5 ORDERED cards under the hit/stand rule and collected the outcomes classified by total of cards, and whether all 5 were needed. Then, to smooth out the SPINNER, we first combined all regular hands from 17-20, and separated the 20's into "royal weddings" of 2 picture cards, a new category similar to but more frequent than blackjack. Finally, a rarest hand is using all 5 cards without getting busted. The derived spinner is shown in the following table and in FIG. 11

Using only 4 games under our multinomial construction, we can achieve a high payback of 2 million coins on a 4 coin bet, as shown by the tables below.

| | Exact number of hands | Probility | t-payoff | adjusted |
|---|---|---|---|---|
| 0 - busted | 87826656 | 0.281608 | | |
| 1 - 17-20 | 166444800 | 0.533690 | 0.374749106 | 1 |
| 2 - twentyone | 21988992 | 0.070506 | 2.836648447 | 1 |
| 3 - royal wedding | 15523200 | 0.049774 | 4.018181818 | 2 |
| 4 - blackjack | 15052800 | 0.048265 | 4.14375 | 3 |
| 5 - Five-Charlie | 5038752 | 0.016156 | 12.37906529 | 7 |
| | 311875200 | 100.00% | 100.00% | 96.16% |

| | | T-payoff | Multibet | adjusted |
|---|---|---|---|---|
| Two hands | | | | |
| 0 | 0.079303255 | | | |
| 1 | 0.30058333 | | | |
| 2 | 0.324535451 | 0.342369719 | 0.684739438 | 1 |
| 3 | 0.103289883 | 1.075721146 | 2.151442291 | 2 |
| 4 | 0.085282522 | 1.302859111 | 2.605718221 | 3 |
| 5 | 0.067635799 | 1.642785526 | 3.285571052 | 4 |
| 6 | 0.026528344 | 4.188392208 | 8.376784416 | 9 |
| 7 | 0.007082931 | 15.68716454 | 31.37432908 | 21 |
| 8 | 0.003937875 | 28.21600799 | 56.43201597 | 50 |
| 9 | 0.001559583 | 71.24409973 | 142.4881995 | 100 |

-continued

| | | | | |
|---|---|---|---|---|
| 10 | 0.000261026 | 425.6701598 | 851.3403195 | 500 |
| | 1.0000000 | 100.00% | 100.00% | 96.42% |
| ThreeHands | | | | |
| 0 | 0.022332458 | | | |
| 1 | 0.126970157 | | | |
| 2 | 0.25740166 | | | |
| 3 | 0.227428818 | 0.338229244 | 1.014687731 | 1 |
| 4 | 0.12081147 | 0.636719983 | 1.91015995 | 2 |
| 5 | 0.103786187 | 0.741168738 | 2.223506214 | 3 |
| 6 | 0.075241382 | 1.022350665 | 3.067051994 | 4 |
| 7 | 0.035394707 | 2.173293199 | 6.519879598 | 7 |
| 8 | 0.015910903 | 4.834614275 | 14.50384282 | 10 |
| 9 | 0.009002924 | 8.544232545 | 25.63269764 | 25 |
| 10 | 0.003909176 | 19.67756648 | 59.03269945 | 50 |
| 11 | 0.001215731 | 63.27312169 | 189.8193651 | 150 |
| 12 | 0.000400528 | 192.0543982 | 576.1631947 | 500 |
| 13 | 0.000151888 | 506.4467439 | 1519.340232 | 1500 |
| 14 | 3.78E−05 | 2035.235451 | 6105.706354 | 5000 |
| 15 | 4.22E−06 | 18240.22627 | 54720.67881 | 50000 |
| | 1.0000000 | 100.00% | 100.00% | 97.30% |
| Four hands | | | | |
| 0 | 0.006289006 | | | |
| 1 | 0.047674473 | | | |
| 2 | 0.141823773 | | | |
| 3 | 0.211482341 | | | |
| 4 | 0.180944056 | 0.325092356 | 1.300369423 | 1 |
| 5 | 0.129038944 | 0.455858731 | 1.823434923 | 2 |
| 6 | 0.110891159 | 0.530461851 | 2.121847405 | 3 |
| 7 | 0.078589428 | 0.748491639 | 2.993966554 | 4 |
| 8 | 0.043346667 | 1.357048489 | 5.428193956 | 5 |
| 9 | 0.024228526 | 2.427862478 | 9.711449911 | 10 |
| 10 | 0.01409753 | 4.172612507 | 16.69045003 | 15 |
| 11 | 0.006779318 | 8.676909838 | 34.70763935 | 30 |
| 12 | 0.002825139 | 20.82146181 | 83.28584723 | 80 |
| 13 | 0.001228413 | 47.88580442 | 191.5432177 | 200 |
| 14 | 0.000514588 | 114.3119354 | 457.2477415 | 500 |
| 15 | 0.000173839 | 338.3790268 | 1353.516107 | 1200 |
| 16 | 5.14E−05 | 1143.339032 | 4573.356127 | 5000 |
| 17 | 1.60E−05 | 3680.944943 | 14723.77977 | 15000 |
| 18 | 4.49E−06 | 13106.61883 | 52426.47533 | 50000 |
| 19 | 8.14E−07 | 72248.39625 | 288993.585 | 200000 |
| 20 | 6.81E−08 | 863341.2869 | 3453365.148 | 2000000 |
| | 1.0000000 | 100.00% | 100.00% | 97.95% |

The foregoing relates to a preferred set of embodiments for the invention of multinomial based slot machines using traditional game models like backgammon and tic tac toe, coin-flipping, dice rolling and variants of poker, blackjack, other card games, as well as random play of board games such as chess, checkers, Othello, and Go. These other embodiments are possible and within the spirit and scope of the invention the latter being defined by the appended claims.

What is claimed:

1. A gaming apparatus comprising a symbol display system for a wagering game, a processor controlling the symbol display system and software executed by the processor, wherein the software is executed by the processor to perform electronic functions of:

a) providing a method of value crediting and debiting that identifies value risked in the play of the wagering game and awards won in the play of the wagering game;

b) providing a game control component that determines rules of play of a first game and a wagering game played on the gaming apparatus;

c) providing activation of selection from virtual spinners consisting of first games that provide first game outcomes that have individual first game determinant outcomes or individual symbol determinant outcomes mathematically distributed within the virtual outcome determinant space of the virtual spinner;

d) providing a file of individual symbols, values and/or images available for display on the symbol display system or retention in memory by the processor, the specific display of individual symbols, values and/or images, sets of symbols or collective symbols being determined by predetermined weighted portions of the virtual outcome determinant space selected by the virtual spinners in the first game;

e) the software responding to user commands to initiate the first game by randomly accessing the predetermined weighted portions of the outcome determinant space to select individual symbols, values and/or images, sets of symbols or collective symbols for use in the wagering game;

f) determining whether the randomly accessed predetermined weighted portions of the outcome determinant space has provided a final set of individual symbols, values and/or images, sets of symbols or collective symbols that constitute a win according to the wagering game; and g) resolving all value placed at risk in the play of the wagering game according to the determination in f).

2. The gaming apparatus of claim 1 wherein the first game comprises a game in which outcomes are determined by one or more displays of symbols selected from group consisting of playing cards, specialty cards, dice and spinners, with each possible outcome for the one or more displays having a probability assigned thereto in the game control component.

3. A method of playing a game on the gaming apparatus of claim 2 wherein portions or totals of player credits are returned to players at player direction by player input to the gaming apparatus either as coins, tokens or printed credit slip.

4. The gaming apparatus of claim 2 wherein the individual symbols, values and/or images consist of numerical values, and the numerical values provided by multiple rounds of play of the first game are summed to form a total value, and the processor is configured to execute code to determine if the total value is a winning outcome.

5. The gaming apparatus of claim 4 wherein first game outcomes are determined by the processor executing code to effect repeated virtual play of the first game producing repeated random selection of predetermined weighted portions of a virtual spinner selected from the group consisting of dice, playing cards and spinners, the processor configured so that each first game outcome makes a limited number of defined moves of the virtual tokens on a virtual backgammon board.

6. The gaming apparatus of claim 5 wherein the virtual game board comprises a truncated backgammon board of at least four positions on a single player side of a backgammon board.

7. The gaming apparatus of claim 6 wherein the processor executes code to perform a random selection of predetermined weighted portions of the outcome determinant space determine discrete outcomes in a board game or card game as the first game.

8. The gaming apparatus of claim 6 wherein the virtual game board has only Six available positions on the virtual game board for positioning of virtual tokens.

9. A method of playing a game on the gaming apparatus of claim 8 wherein portions or totals of player credits are returned to players at player direction by player input to the gaming apparatus either as coins, tokens or printed credit slip.

10. The gaming apparatus of claim 1 wherein the selective symbols are selected from the group consisting of symbols to be randomly displayed, markers to fill preexisting spaces in a game board, playing cards, dice and coins.

11. The gaming apparatus of claim 10 wherein the processor is configured to execute code such that each symbol or a set of symbols in the wagering game is determined by the software according to the random selection of the predetermined weighted portions of the outcome determinant space in the first game.

12. The gaming apparatus of claim 1 wherein outcomes from the virtual spinner are selected from the group consisting of a distinguished LOSE state, and a set of winning states each determined by a weighted probability of outcomes in the first game, wherein each weighted probability is used to calculate binomial or multinomial coefficients that are summed and which determine the payout levels.

13. The apparatus of claim 1 wherein the processor executes code such that predetermined weighted portions of the outcome determinant space is constructed based on real-life events in the first game having determinable probabilities, wherein an actual probability distribution of the real-life event is mathematically distributed as segments within a region that is the basis of selection by a random number generator, further wherein the random number generator randomly selects among the statistical regions provided by the real-life event for the first game and symbol outcomes or event outcomes are associated with each of these regions so that selection of any region determines a symbol outcome or an event outcome in the wagering game.

14. The method of claim 1 wherein the processor is configured to execute code such that predetermined weighted portions of the outcome determinant space are constructed based on real-life events of the first game having determinable probabilities, wherein an actual probability distribution of the real-life event is mathematically distributed as segments within a virtual region that is the basis of selection by a random number generator, further wherein the random number generator randomly selects among the statistical regions provided by the real-life event of the first game and symbol outcomes for the wagering game or event outcomes for the wagering game are associated with each of these regions so that selection of any region in the first game determines a symbol outcome or an event outcome for the wagering game.

15. A gaming apparatus comprising a symbol display system for a wagering game, a processor executing code to control images displayed on the symbol display system and software executed by the processor, wherein the software present in memory and executable by the processor enables the ability to perform electronic functions of:

a) providing a method of value crediting and debiting system that identifies value risked in the play of the wagering game and awards won in the play of the wagering game;

b) providing a game control component that determines rules of play of a first game and a wagering game played on the gaming apparatus;

c) providing activation of selection from virtual spinners that have individual first game determinant outcomes mathematically distributed within a virtual outcome determinant space of the virtual spinner;

d) providing a file of images available for display on the symbol display system, the specific display of individual symbols, sets of symbols or collective symbols useful in the wagering game being determined by the processor executing coder to play the first game, and the first game results, the processor containing code that when executed provides from the predetermined weighted portions of the outcome determinant space a symbol, number or first game outcome;

e) the processor executing code on the software in response to user commands to initiate a wagering game by first randomly accessing the predetermined weighted portions of the outcome determinant space in the first game and then executing code to select individual symbols, sets of symbols, values that are summed by the processor or collective symbols for use in the wagering game;

f) determining whether the randomly accessed predetermined weighted portions of the outcome determinant space has provided individual symbols, sets of symbols, sums of values or collective symbols that constitute a win according to the game; and g) resolving all value placed at risk in the play of the game according to the determination in f), wherein the virtual spinner used in the first game consists of a processor executed code that simulates a virtually played game of cards selected from the group consisting of blackjack, poker and baccarat and an ending of the game of cards determine a separate symbol or event outcome for use in the wagering game from a look-up table.

16. The gaming apparatus of claim 15 wherein the first game comprises a first game in which the first game outcomes are determined by one or more displays of symbols selected from group consisting of playing cards, specialty cards, dice and spinners, with each possible outcome for the one or more displays having a probability assigned thereto in the first game control component and the physical spinner provides different symbols than are used in the wagering game outcome.

17. The gaming apparatus of claim 16 wherein the file of images stored in memory and accessible by the processor for display in the wagering game include virtual dice and virtual token positions on a virtual game board, the virtual token positions representing at least three positions on a virtual backgammon board.

* * * * *